US007089187B2

(12) United States Patent
Kondo et al.

(10) Patent No.: US 7,089,187 B2
(45) Date of Patent: Aug. 8, 2006

(54) VOICE SYNTHESIZING SYSTEM, SEGMENT GENERATION APPARATUS FOR GENERATING SEGMENTS FOR VOICE SYNTHESIS, VOICE SYNTHESIZING METHOD AND STORAGE MEDIUM STORING PROGRAM THEREFOR

(75) Inventors: Reishi Kondo, Tokyo (JP); Hiroaki Hattori, Tokyo (JP)

(73) Assignee: NEC Corporation, Tokyo (JP)

( * ) Notice: Subject to any disclaimer, the term of this patent is extended or adjusted under 35 U.S.C. 154(b) by 856 days.

(21) Appl. No.: 10/254,666

(22) Filed: Sep. 26, 2002

(65) Prior Publication Data

US 2003/0061051 A1 Mar. 27, 2003

(30) Foreign Application Priority Data

Sep. 27, 2001 (JP) ..... 2001-296742

(51) Int. Cl.
*G10L 13/06* (2006.01)

(52) U.S. Cl. ..... 704/267

(58) Field of Classification Search ..... None
See application file for complete search history.

(56) References Cited

U.S. PATENT DOCUMENTS

| | | | | |
|---|---|---|---|---|
| 4,833,718 | A * | 5/1989 | Sprague | 704/260 |
| 4,852,168 | A * | 7/1989 | Sprague | 704/260 |
| 5,671,330 | A * | 9/1997 | Sakamoto et al. | 704/267 |
| 5,740,320 | A * | 4/1998 | Itoh | 704/267 |
| 5,845,047 | A * | 12/1998 | Fukada et al. | 704/268 |
| 5,950,152 | A * | 9/1999 | Arai et al. | 704/268 |
| 5,970,453 | A * | 10/1999 | Sharman | 704/260 |
| 6,067,519 | A * | 5/2000 | Lowry | 704/267 |
| 6,212,501 | B1 * | 4/2001 | Kaseno | 704/258 |
| 6,304,846 | B1 * | 10/2001 | George et al. | 704/270 |
| 2002/0049594 | A1 * | 4/2002 | Moore et al. | 704/258 |

FOREIGN PATENT DOCUMENTS

| | | | |
|---|---|---|---|
| JP | S56-089800 | A | 7/1981 |
| JP | S56-106298 | A | 8/1981 |
| JP | S58-178399 | A | 10/1983 |
| JP | S60-140299 | A | 7/1985 |
| JP | S62-094900 | A | 5/1987 |
| JP | S64-076100 | A | 3/1989 |
| JP | H01-195500 | A | 8/1989 |
| JP | H02-042497 | A | 2/1990 |
| JP | H04-281499 | A | 10/1992 |
| JP | H05-068081 | A | 3/1993 |
| JP | H05-119795 | A | 5/1993 |
| JP | H10-171484 | A | 6/1998 |

(Continued)

*Primary Examiner*—David D. Knepper
(74) *Attorney, Agent, or Firm*—Sughrue Mion, PLLC

(57) ABSTRACT

A voice synthesizing system can make necessary calculation amount satisfactorily small and can make necessary file size small. The system includes a compressed pitch segment database storing compressed voice waveform segments, a pitch developing portion reading out the voice waveform segment from the database and decompressing the compressed data for reproducing an original voice waveform segment when the voice waveform segment necessary for voice waveform synthesis is demanded, and a cache processing portion temporarily storing the voice waveform segment already used in voice waveform synthesis, and when voice waveform segment necessary for voice waveform synthesis is demanded, returning demanded voice waveform segment to a demander when demanded voice waveform segment is already stored, and obtaining the voice waveform segment from the database via the pitch developing portion to hold the obtained voice waveform segment and return to the demander when demanded voice waveform segment is not stored.

37 Claims, 14 Drawing Sheets

FOREIGN PATENT DOCUMENTS

| | | | |
|---|---|---|---|
| JP | 2000-267688 | A | 9/2000 |
| JP | 2001-154683 | A | 6/2001 |
| JP | 2001-166796 | A | 6/2001 |
| JP | 2001-324991 | A | 11/2001 |
| JP | 2002-091475 | A | 3/2002 |
| JP | 2002-258894 | A | 9/2002 |
| JP | 2002-87784 | A | 10/2002 |
| WO | WO 99/59133 | A1 | 11/1999 |

* cited by examiner

CONTENT OF CONTINUITY TABLE

| PITCH NUMBER | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | --- |
|---|---|---|---|---|---|---|---|---|---|---|---|---|---|---|---|---|---|---|---|---|---|---|---|---|---|---|
| NUMBER OF SEQUENTIAL SEGMENT | 0 | 1 | 1 | 1 | 1 | 5 | 1 | 1 | 1 | 1 | 1 | 1 | 1 | 1 | 1 | 1 | 1 | 1 | 1 | 1 | 2 | 1 | 1 | 1 | 1 | --- |
| AMPLITUDE MULTIPLYING FACTOR | 1ST:1.00<br>2ND:1.07<br>3RD:1.13<br>4TH:1.12<br>5TH:1.24<br>6TH:1.18<br>7TH:1.22 | | | | | 1ST:1.00<br>2ND:0.95<br>3RD:0.89<br>4TH:0.92<br>5TH:1.04 | | | | | 1ST:1.00<br>2ND:0.95<br>3RD:0.89<br>4TH:0.92 | | | | | | | | | | 1ST:1.00<br>2ND:1.10 | | | | | --- |

CONTENT OF PITCH INDEX TABLE

| PITCH INDEX | 0 | 1 | 2 | 3 | 4 | 5 | 6 | 7 | 8 | 9 | 10 | 11 | 12 | 13 | 14 | 15 | 16 | 17 | 18 | 19 |
|---|---|---|---|---|---|---|---|---|---|---|---|---|---|---|---|---|---|---|---|---|
| PITCH NUMBER | 0 | 0 | 0 | 1 | 0 | 1 | 1 | 1 | 2 | 3 | 0 | 4 | 5 | 1 | 1 | 6 | 7 | 8 | 0 | 9 |
| AMPLITUDE MULTIPLYING FACTOR | 0.94 | 1.00 | 1.03 | 0.94 | 1.12 | 0.97 | 1.01 | 1.00 | 1.00 | 1.00 | 1.19 | 1.00 | 1.00 | 0.95 | 0.96 | 1.00 | 1.00 | 1.00 | 1.31 | 1.00 |
| TIME DIRECTION SHIFT | 0 | 0 | 1 | 3 | −2 | 1 | −1 | 0 | 2 | 2 | 7 | −1 | −3 | 0 | −2 | 1 | 2 | 0 | −1 | −1 |

| PITCH INDEX | 20 | 21 | 22 | 23 | 24 | 25 | 26 | 27 | 28 | 29 | 30 | 31 | 32 | 33 | 34 | 35 | 36 | 37 | 38 | --- |
|---|---|---|---|---|---|---|---|---|---|---|---|---|---|---|---|---|---|---|---|---|
| PITCH NUMBER | 10 | 10 | 10 | 10 | 11 | 12 | 13 | 14 | 13 | 15 | 13 | 16 | 17 | 18 | 0 | 0 | 19 | 20 | 21 | --- |
| AMPLITUDE MULTIPLYING FACTOR | 0.85 | 0.85 | 0.89 | 1.00 | 1.00 | 1.00 | 1.00 | 1.00 | 1.03 | 1.00 | 0.94 | 1.00 | 1.00 | 1.00 | 0.78 | 0.81 | 1.00 | 1.00 | 1.00 | --- |
| TIME DIRECTION SHIFT | 1 | 0 | 0 | 0 | 1 | −1 | 1 | −2 | −4 | 3 | 1 | 1 | 0 | 1 | 0 | 0 | 0 | 2 | 1 | --- |

VOICE SYNTHESIZING SYSTEM, SEGMENT GENERATION APPARATUS FOR GENERATING SEGMENTS FOR VOICE SYNTHESIS, VOICE SYNTHESIZING METHOD AND STORAGE MEDIUM STORING PROGRAM THEREFOR

BACKGROUND OF THE INVENTION

1. Field of the Invention

The present invention relates to a voice synthesizing system for synthesizing a voice by editing waveform, a segment generation apparatus for generating information necessary for voice synthesis, a voice synthesizing method and a storage medium storing a program for implementing the voice synthesizing method.

2. Description of the Related Art

There has been known a waveform concatenation system as a method for voice synthesis by rule.

The waveform concatenation system is a system for obtaining synthesized voice by extracting large amount of voice waveform segments in a pitch length, syllable length or so forth from a natural voice, storing the voice waveform segments in a storage device together with information of a phonemic environment, pitch shape in phonemes, amplitude, continuing period and so forth, and reading out optimal voice waveform segments according to rhythmic information or phonemic information set by synthesizing rule for obtaining a synthesized voice by connecting the read out voice waveform segments.

In the waveform concatenation system, while high quality synthesized voice can be obtained easily, it encounters a problem in that a large amount of voice waveform segments for generating synthesized voice have to be stored to make file size of the voice waveform segments excessively large. Particularly, this is significant when the voice waveform segments are extracted per pitch unit from voiced sound, in which the voice waveform segment thus extracted will be referred hereinafter as "pitch segment").

As an approach for this problem, attempt has been made to store the voice waveform segments in compressed form in a storage device and read out them in decompressed form from the storage device. However, calculation amount to decompress the compressed voice waveform segments becomes large.

In the conventional voice synthesizing system, since the voice waveform segments to be used are decompressed individually upon voice synthesis respectively, calculation amount therefor becomes large. Particularly, increasing of calculation amount becomes significant at higher pitch frequency of the synthesized voice.

On the other hand, while the voice segment database included in the conventional voice synthesizing system may have the voice segment database smaller than that should be by compressing respective voice waveform segments, further smaller size of data base has been required in some applications. However, the conventional voice synthesizing system cannot satisfy such demand.

SUMMARY OF THE INVENTION

The present invention has been worked out for providing solution for the problems or drawbacks in the prior art set forth above. Therefore, it is an object of the present invention to provide a voice synthesizing system which cam make necessary calculation amount satisfactorily small, upon voice synthesis, and can make file size required for storing voice waveform segments satisfactorily small.

In order to accomplish the above-mentioned object, according to the first aspect of the present invention, a voice synthesizing system synthesizing a predetermined voice waveform by overlaying a plurality of voice waveform segments in a waveform concatenation method, comprises:

a compressed pitch segment database storing respective voice waveform segments compressed per pitch unit;

a pitch developing portion reading out compressed data of the voice waveform segment from the compressed pitch segment database and decompressing the read out compressed data for reproducing an original voice waveform segment when the voice waveform segment necessary for voice waveform synthesis is demanded;

a cache processing portion temporarily storing the voice waveform segment already used in voice waveform synthesis, and when voice waveform segment necessary for voice waveform synthesis is demanded, returning demanded voice waveform segment to a demander when demanded voice waveform segment is already stored, and obtaining the voice waveform segment from the compressed pitch segment database via the pitch developing portion to hold the obtained voice waveform segment and conjunction therewith to return to the demander when demanded voice waveform segment is not stored.

The voice synthesizing system may further comprise:

a continuity table respectively storing number of sequential voice waveform segment and amplitude multiplying factors per voice waveform segment with respect to a representative voice waveform segment when a plurality of sequential voice waveform segments can be replaced with one representative voice waveform segment; and a pitch index converting portion obtaining the voice waveform segment from the cache processing portion with reference to the continuity table and returns the voice waveform segment to the demander with amplification thereof by a value of the amplitude multiplying factor when the voice waveform segment necessary for voice waveform synthesis is demanded, the compressed pitch segment database stores the representative voice waveform segments and the voice waveform segments which cannot be replaced with the representative voice waveform segment.

On the other hand, the voice synthesizing system may further comprise:

a pitch index table storing amplitude multiplying factor per voice waveform segment with respect to the representative voice waveform segment and number of samples for shifting voice waveform segment in time direction when a plurality of voice waveform segments can be replaced with one representative voice waveform segment; and a pitch index converting portion obtaining the voice waveform segment from the cache processing portion with reference to the pitch index table, amplifying the voice waveform segments by a value of the amplitude multiplying factor, and returning the voice waveform segments to the demander with shifting the voice waveform segment in time direction with the number of samples, when the voice waveform segment necessary for voice waveform synthesis is demanded, the compressed pitch segment database stores the representative voice waveform segments and the voice waveform segments which cannot be replaced with the representative voice waveform segment.

Also, the voice synthesizing system may further comprise:

a continuity table respectively storing number of sequential voice waveform segment and amplitude multiplying factors per voice waveform segment with respect to a representative voice waveform segment when a plurality of sequential voice waveform segments can be replaced with one representative voice waveform segment; and a pitch index table storing amplitude multiplying factor per voice waveform segment with respect to the representative voice waveform segment and number of samples for shifting voice waveform segment in time direction when a plurality of voice waveform segments can be replaced with one representative voice waveform segment; and a pitch index converting portion obtaining the voice waveform segment from the cache processing portion with reference to one of the continuity table and the pitch index table, amplifying the voice waveform segments at least by a value of the amplitude multiplying factor, and returning the voice waveform segments to the demander, when the voice waveform segment necessary for voice waveform synthesis is demanded, the compressed pitch segment database stores the representative voice waveform segments and the voice waveform segments which cannot be replaced with the representative voice waveform segment.

According to the second aspect of the present invention, a voice waveform segment generating apparatus for voice synthesis extracting a plurality of voice waveform segments from a voice waveform of an original human speech and generating information for selecting voice waveform segment necessary for voice synthesis among extracted voice waveform segments, comprises:

a sequential representative pitch segment determining portion selecting a range where voice waveform segments are regarded as the same voice waveform segment in a sequential zone and selecting representative voice waveform segment among voice waveform segments in the range;

a pitch segment registering portion storing the representative voice waveform segment and the voice waveform segments out of the range in a database in compressed form; and a continuity table generating portion calculating number of sequential voice waveform segments in the range and amplitude multiplying factor per voice waveform segment with respect to the representative voice waveform segment and storing in a storage device in a form of table.

The sequential representative pitch segment determining portion may set the voice waveform segments contained in the range in number less than a predetermined number.

According to the third aspect of the present invention, a voice waveform segment generating apparatus for voice synthesis extracting a plurality of voice waveform segments from a voice waveform of an original human speech and generating information for selecting voice waveform segment necessary for voice synthesis among extracted voice waveform segments, comprises:

a representative pitch segment determining portion selecting a set of voice waveform segments which can be regarded as the same voice waveform and selecting representative voice waveform segment among voice waveform segments in the set;

a pitch segment registering portion storing the representative waveform segment and the voice waveform segments out of the set in a database in compressed form; and a pitch index table generating portion calculating amplitude multiplying factor per each voice waveform segment in the set with respect to the representative voice waveform segments and number of samples for shifting the voice waveform segment in time direction, and storing in a storage device in a form of table.

The representative pitch segment determining portion may set the voice waveform segments contained in the sets in number less than a predetermined number.

According to the fourth aspect of the present invention, a voice waveform segment generating apparatus for voice synthesis extracting a plurality of voice waveform segments from a voice waveform of an original human speech and generating information for selecting voice waveform segment necessary for voice synthesis among extracted voice waveform segments, comprises:

a sequential representative pitch segment determining portion selecting a range where voice waveform segments are regarded as the same voice waveform segment in a sequential zone and selecting representative voice waveform segment among voice waveform segments in the range;

a representative pitch segment determining portion selecting a set of voice waveform segments which can be regarded as the same voice waveform with respect to the result of selection by the sequential representative pitch segment determining portion and selecting representative voice waveform segment among voice waveform segments in the set;

a pitch segment registering portion storing the representative waveform segment in the set and the voice waveform segments out of the set in a database in compressed form;

a continuity table generating portion calculating number of voice waveform segments in the range and amplitude multiplying factor per voice waveform segment with respect to the voice waveform segment and storing in a storage device in a form of table; and a pitch index table generating portion calculating amplitude multiplying factor per each voice waveform segment in the set with respect to the representative voice waveform segments and number of samples for shifting the voice waveform segment in time direction, and storing in a storage device in a form of table.

The sequential representative pitch segment determining portion may set the voice waveform segments contained in the range in number less than a predetermined number, and the representative pitch segment determining portion may set the voice waveform segments contained in the sets in number less than a predetermined number.

The voice synthesizing segment generating apparatus may further comprise a class discriminating portion dividing the voice waveform segments including result of selection by the continuous representative pitch segment determining portion into a preliminarily set plurality of classes using a phoneme, in which the voice waveform segment belongs, a preceding phoneme immediately preceding to the phoneme, in which the voice waveform segment belongs, and a following phoneme immediately following to the phoneme, in which the voice waveform segment belongs, and the representative pitch segment determining portion may select set of the voice waveform segment regarded as the same voice waveform segment per the class.

The representative pitch segment determining portion may select representative voice waveform segments of the immediately preceding and immediately following sets and the voice waveform segments sequential in time when the representative voice waveform segment may be selected among the voice waveform segments in the set.

The voice synthesizing segment generating apparatus may further comprise a phase replacing portion performing predetermined phase replacement for the phoneme and the voice waveform segments preliminarily determined depending upon phonemic environment.

In the voice synthesizing system and the voice synthesizing segment generating apparatus constructed as set forth above, the voice waveform segment already used in voice synthesis is temporarily stored. By providing the cache processing portion, the voice waveform segment is returned to the demander when the voice waveform segment necessary for voice waveform synthesis is demanded, and if the demanded voice waveform segment is stored, and if not stored, the voice waveform segment is obtained from the compressed pitch segment database via the pitch developing portion to store the obtained voice waveform segment and return the obtained voice waveform segment to the demander. Therefore, when the voice waveform segment is already stored in the cache processing portion, it becomes unnecessary to read out and decompress the compressed data stored in the compressed pitch segment database.

On the other hand, by providing the a continuity table respectively storing number of sequential voice waveform segment and amplitude multiplying factors per voice waveform segment with respect to a representative voice waveform segment when a plurality of sequential voice waveform segments can be replaced with one representative voice waveform segment, and a pitch index converting portion obtaining the voice waveform segment from the cache processing portion with reference to the continuity table and returns the voice waveform segment to the demander with amplification thereof by a value of the amplitude multiplying factor when the voice waveform segment necessary for voice waveform synthesis is demanded, a plurality of the voice waveform segments to be stored in the compressed pitch segment database can be replaced with one representative voice waveform segment.

Similarly, by providing the pitch index table storing amplitude multiplying factor per voice waveform segment with respect to the representative voice waveform segment and number of samples for shifting voice waveform segment in time direction when a plurality of voice waveform segments can be replaced with one representative voice waveform segment, and the pitch index converting portion obtaining the voice waveform segment from the cache processing portion with reference to the pitch index table, amplifying the voice waveform segments by a value of the amplitude multiplying factor, and returning the voice waveform segments to the demander with shifting the voice waveform segment in time direction with the number of samples, when the voice waveform segment necessary for voice waveform synthesis is demanded, a plurality of the voice waveform segments to be stored the compressed pitch segment database can be replaced with one representative voice waveform segment.

According to the fifth aspect of the present invention, a voice synthesizing method for synthesizing a desired voice waveform by overlaying a plurality of voice waveform segments in waveform concatenation method, comprises the steps of:

preliminarily storing compressed voice waveform segments in a database;

returning the voice waveform segment to a demander when the voice waveform segment necessary for voice waveform synthesis is demanded and when the demanded voice waveform segment is already stored in a cache memory;

reading out the compressed data of the voice waveform segment from the database storing the compressed data of the voice waveform segments and reproducing an original voice waveform segment by decompressing the read out compressed data; and storing the reproduced voice waveform segment in the cache memory and returning to the demander.

The voice synthesizing method may further comprise the steps of:

preliminarily storing number of sequential voice waveform segment and amplitude multiplying factor per each voice waveform segment with respect to the representative voice waveform segment when a plurality of sequential voice waveform segments can be replaced with one representative voice waveform segment;

obtaining the voice waveform segment from the cache memory when the voice waveform segment necessary for voice waveform synthesis is demanded; and returning the voice waveform segment to the demander with amplification by a value of the amplitude multiplying factor.

The voice synthesizing method may further comprise the steps of:

preliminarily storing amplitude multiplying factor per each voice waveform segment with respect to the representative voice waveform segment and number of samples for shifting the voice waveform segments in time direction when a plurality of voice waveform segments can be replaced with one representative voice waveform segment;

obtaining the voice waveform segment from the cache memory when the voice waveform segment necessary for voice waveform synthesis is demanded; and returning the voice waveform segment to the demander with amplification by a value of the amplitude multiplying factor and shifting the voice waveform segment by the sample number.

According to the sixth aspect of the present invention, a voice synthesizing segment generating method extracting a plurality of voice waveform segments from an originally spoken human speech and generating information for selecting the voice waveform segment necessary for voice synthesis from the extracted voice waveform segment, comprises the steps of:

selecting range, in which the voice waveform segments are regarded as the same within a sequential zone among all of voice waveform segments consisting the original speech, and selecting a representative voice waveform segment from the voice waveform segment within the range;

storing the representative voice waveform segments and the voice waveform segment other than the range in a database in compressed form; and calculating number of sequential voice waveform segments within the range and amplitude multiplying factor per each waveform segment with respect to the representative voice waveform segment and storing in a storage device in a form of table.

The number of the voice waveform segments contained in the range may be less than a predetermined number.

According to the seventh aspect of the present invention, a voice synthesizing segment generating method extracting a plurality of voice waveform segments from an originally spoken human speech and generating information for selecting the voice waveform segment necessary for voice synthesis from the extracted voice waveform segment, comprises the steps of:

selecting set of the voice waveform segments regarded as the same among all of voice waveform segments consisting the original speech, and selecting a representative voice waveform segment from the voice waveform segment within the set;

storing the representative voice waveform segments and the voice waveform segment other than the set in a database in compressed form; and calculating amplitude multiplying factor per each waveform segment with respect to the representative voice waveform segment and number of samples for shifting the voice wave form in a time direction, in the set and storing in a storage device in a form of table.

The number of the voice waveform segments contained in the set may be less than a predetermined number.

According to the eighth aspect of the present invention, a voice synthesizing segment generating method extracting a plurality of voice waveform segments from an originally spoken human speech and generating information for selecting the voice waveform segment necessary for voice synthesis from the extracted voice waveform segment, comprises the steps of:

selecting range, in which the voice waveform segments are regarded as the same within a sequential zone among all of voice waveform segments consisting the original speech, and selecting a representative voice waveform segment from the voice waveform segment within the range;

with respect to the result of selection, selecting set of the voice waveform segments regarded as the same voice waveform segment, and selecting a representative voice waveform segment from the voice waveform segment within the set;

calculating number of the voice waveform segments within the range and amplitude multiplying factor per each waveform segment with respect to the representative voice waveform segment and storing in a storage device in a form of table; and calculating amplitude multiplying factor per each waveform segment with respect to the representative voice waveform segment and number of samples for shifting the voice wave form in a time direction, in the set and storing in a storage device in a form of table.

Number of the voice waveform segments contained in the range may be less than a predetermined number, and number of the voice waveform segments contained in the set may be less than a predetermined number.

The voice synthesizing segment generating method may further comprise steps of dividing the voice waveform segments including result of selection by the continuous representative pitch segment determining portion into a preliminarily set plurality of classes using a phoneme, in which the voice waveform segment belongs, a preceding phoneme immediately preceding to the phoneme, in which the voice waveform segment belongs, and a following phoneme immediately following to the phoneme, in which the voice waveform segment belongs, and selecting set of the voice waveform segment regarded as the same voice waveform segment per the class.

The representative voice waveform segments of the immediately preceding and immediately following sets and the voice waveform segments sequential in time may be selected when the representative voice waveform segment is selected among the voice waveform segments in the set.

The voice synthesizing segment generating method may further comprise a step of performing predetermined phase replacement for the phoneme and the voice waveform segments preliminarily determined depending upon phonemic environment.

According to the ninth aspect of the present invention, a storage medium recording a program for synthesizing a desired voice waveform by overlaying a plurality of voice waveform segments in waveform concatenation method, the program comprises the steps of:

preliminarily storing compressed voice waveform segments in a database;

returning the voice waveform segment to a demander when the voice waveform segment necessary for voice waveform synthesis is demanded and when the demanded voice waveform segment is already stored in a cache memory;

reading out the compressed data of the voice waveform segment from the database storing the compressed data of the voice waveform segments and reproducing an original voice waveform segment by decompressing the read out compressed data; and storing the reproduced voice waveform segment in the cache memory and returning to the demander.

In the storage medium, the program may further comprise the steps of:

preliminarily storing number of sequential voice waveform segment and amplitude multiplying factor per each voice waveform segment with respect to the representative voice waveform segment when a plurality of sequential voice waveform segments can be replaced with one representative voice waveform segment;

obtaining the voice waveform segment from the cache memory when the voice waveform segment necessary for voice waveform synthesis is demanded; and returning the voice waveform segment to the demander with amplification by a value of the amplitude multiplying factor.

In the storage medium, the program may further comprise the steps of:

preliminarily storing amplitude multiplying factor per each voice waveform segment with respect to the representative voice waveform segment and number of samples for shifting the voice waveform segments in time direction when a plurality of voice waveform segments can be replaced with one representative voice waveform segment;

obtaining the voice waveform segment from the cache memory when the voice waveform segment necessary for voice waveform synthesis is demanded; and returning the voice waveform segment to the demander with amplification by a value of the amplitude multiplying factor and shifting the voice waveform segment by the sample number.

According to the tenth aspect of the present invention, a storage medium recording a program extracting a plurality of voice waveform segments from an originally spoken human speech and generating information for selecting the voice waveform segment necessary for voice synthesis from the extracted voice waveform segment, the program comprises the steps of:

selecting range, in which the voice waveform segments are regarded as the same within a sequential zone among all of voice waveform segments consisting the original speech, and selecting a representative voice waveform segment from the voice waveform segment within the range;

storing the representative voice waveform segments and the voice waveform segment other than the range in a database in compressed form; and calculating number of sequential voice waveform segments within the range and amplitude multiplying factor per each waveform segment with respect to the representative voice waveform segment and storing in a storage device in a form of table.

Number of the voice waveform segments contained in the range is less than a predetermined number.

According to the eleventh aspect of the present invention, a storage medium recording a program extracting a plurality of voice waveform segments from an originally spoken human speech and generating information for selecting the voice waveform segment necessary for voice synthesis from the extracted voice waveform segment, the program comprises the steps of:

selecting set of the voice waveform segments regarded as the same among all of voice waveform segments consisting the original speech, and selecting a representative voice waveform segment from the voice waveform segment within the set;

storing the representative voice waveform segments and the voice waveform segment other than the set in a database in compressed form; and calculating amplitude multiplying factor per each waveform segment with respect to the representative voice waveform segment and number of samples for shifting the voice wave form in a time direction, in the set and storing in a storage device in a form of table.

Number of the voice waveform segments contained in the set is less than a predetermined number.

According to the twelfth aspect of the present invention, a storage medium recording a program extracting a plurality of voice waveform segments from an originally spoken human speech and generating information for selecting the voice waveform segment necessary for voice synthesis from the extracted voice waveform segment, the program comprises the steps of:

selecting range, in which the voice waveform segments are regarded as the same within a sequential zone among all of voice waveform segments consisting the original speech, and selecting a representative voice waveform segment from the voice waveform segment within the range;

with respect to the result of selection, selecting set of the voice waveform segments regarded as the same voice waveform segment, and selecting a representative voice waveform segment from the voice waveform segment within the set;

calculating number of the voice waveform segments within the range and amplitude multiplying factor per each waveform segment with respect to the representative voice waveform segment and storing in a storage device in a form of table; and calculating amplitude multiplying factor per each waveform segment with respect to the representative voice waveform segment and number of samples for shifting the voice wave form in a time direction, in the set and storing in a storage device in a form of table.

Number of the voice waveform segments contained in the range may be less than a predetermined number, and number of the voice waveform segments contained in the set may be less than a predetermined number.

In the storage segment, the program may further comprise steps of:

dividing the voice waveform segments including result of selection by the continuous representative pitch segment determining portion into a preliminarily set plurality of classes using a phoneme, in which the voice waveform segment belongs, a preceding phoneme immediately preceding to the phoneme, in which the voice waveform segment belongs, and a following phoneme immediately following to the phoneme, in which the voice waveform segment belongs, and selecting set of the voice waveform segment regarded as the same voice waveform segment per the class.

The representative voice waveform segments of the immediately preceding and immediately following sets and the voice waveform segments sequential in time may be selected when the representative voice waveform segment is selected among the voice waveform segments in the set.

The program may further comprise a step of performing predetermined phase replacement for the phoneme and the voice waveform segments preliminarily determined depending upon phonemic environment.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to the invention, but are for explanation and understanding only.

In the drawings.

DESCRIPTION OF THE PREFERRED EMBODIMENT

The present invention will be discussed hereinafter in detail in terms of the preferred embodiment of voice synthesizing system according to the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structure is not shown in detail in order to avoid unnecessary obscurity of the present invention.

First Embodiment

Figure 1:
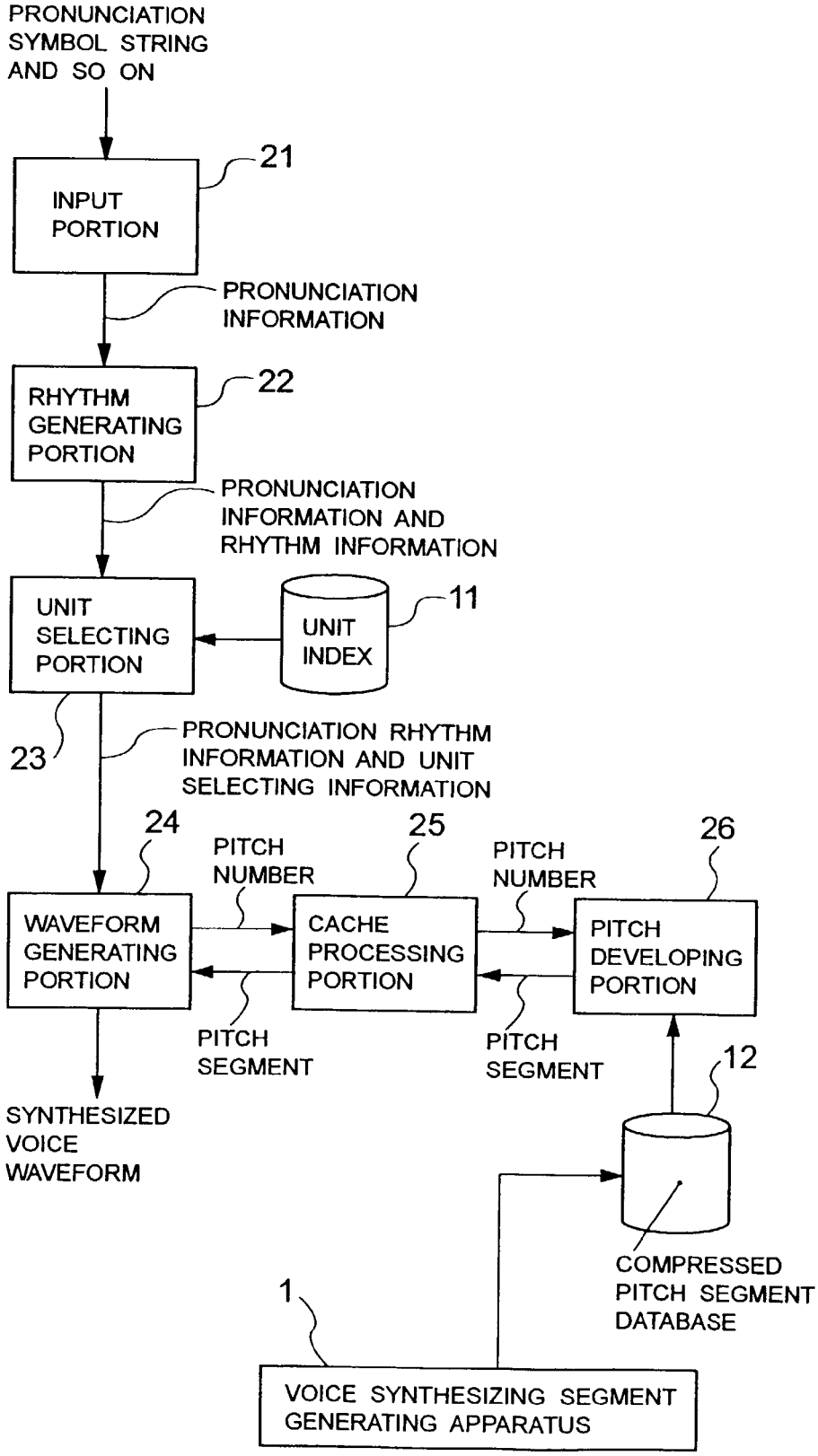
FIG. 1 is a block diagram showing a construction of the first embodiment of a voice synthesizing system according to the present invention.

FIG. 1 is a block diagram showing a construction of the first embodiment of a voice synthesizing system according to the present invention.

As shown in FIG. 1, the first embodiment of a voice synthesizing system is constructed with an input portion 21, a rhythm generating portion 22, a unit selecting portion 23, a unit index 11, a waveform generating portion 24, a cache processing portion 25, a pitch developing portion 26 and a compressed pitch segment database 12.

In the unit index 11, storage position of pitch segments to be used for voice synthesis, number, information for selecting synthesizing unit (spectrum characteristics, pitch frequency and so forth) are stored together with a preliminarily given predetermined index. On the other hand, in the compressed pitch segment database 12, compressed pitch segments (compressed data) and pitch number as number indicative of storage position of the compressed data are stored, respectively. As compression method of the pitch segment, ADPCM (Adaptive Differential Pulse Code Modulation), CELP (Code Excited Linear Prediction), VSELP (Vector Sum Excited Linear Prediction) and so forth have been known.

The input portion 21 converts pronunciation symbol string and so forth as voice synthesizing objects into pronunciation information. The pronunciation symbol string is consisted of kana (Japanese character) string or string of symbols indicating pronunciation and/or accent, and is a character string expressing text or sentence as object to synthesis. On the other hand, the pronunciation information is information obtained by converting the content equivalent to pronunciation symbol string into a format to be easily handled in the process of the rhythm generating portion.

The rhythm generating portion 22 generates a rhythm information including a pitch pattern and/or continuing period for providing accent, intonation, pause and so forth to the synthesized voice, from the pronunciation information.

The unit selecting portion 23 selects a synthesizing unit to be used for waveform generation per a predetermined zone with reference to information stored in the unit index 11 from the pronunciation information and rhythm information to generate unit selection information indicative of the result of selection. In the synthesizing unit, CV/VC/CVC/VCV/phoneme/syllable/variable length (c: consonant, V: vowel) and so forth are present. In the shown embodiment, the difference does not matter.

The waveform generating portion 24 generates the synthesized voice waveform according to waveform concatenation method from the pronunciation information, rhythm information and unit selection information.

In the synthesized voice, zones of voiced sound, voiceless sound, silence are included. Particularly, concerning the zone of voiced sound, on the basis of the pitch pattern in the rhythm information and continuation period, pitch driving timing and pitch index as number indicative of the pitch segment to be used are respectively selected in time series. In the shown embodiment, the value of the pitch index is set at the same value as the pitch number stored in the compressed pitch segment database 12.

The waveform generating portion 24 transmits the corresponding pitch number to the cache processing portion 25 in order to obtain the pitch segment for use in voice synthesis, and obtains corresponding pitch segment from the cache processing portion 25. By sequentially overlaying thus obtained pitch segments, the synthesized voice waveform of the voiced sound can be generated.

The cache processing portion 25 has a cache memory temporarily holding the pitch segment already used in voice synthesis by the waveform generating portion and the pitch number corresponding thereto, respectively. When a pitch segment obtaining demand by the pitch number is presented from the waveform generating portion 24, the cache processing portion 25 checks whether the pitch segment corresponding to the pitch number is already held or not. When the pitch segment corresponding to the pitch number is already present, the corresponding pitch segment is returned to the waveform generating portion 24. On the other hand, when the pitch segment corresponding to the pitch number is not held, transmission of the pitch segment corresponding to the pitch number is demanded to the pitch developing portion 26. Then, obtained pitch segment is returned to the waveform generating portion 24. In conjunction therewith, the pitch segments are accumulated with correspondence with the pitch numbers.

The pitch developing portion 26 is responsive to the pitch segment obtaining demand by the pitch number from the cache processing portion 25, to read out the compressed data corresponding to the pitch number from the compressed pitch segment database 12, to reproduce the original pitch segment by decompressing the read out compressed data, to return to the cache processing portion 25.

In the voice synthesizing process of waveform concatenation method, the same pitch segments are frequently used for a plurality of times sequentially or non-sequentially, for the reason that the pitch frequency and speech speed do not always match with the original speech of the used pitch segment and that interpolation is required between the pitch segments. On the other hand, upon speech synthesis by rule, the same pitch segments can be used for a plurality of times in some speech content.

In the shown embodiment, when the pitch segments are already held in the cache processing portion 25, the held pitch segments are used for voice synthesis in the waveform generating portion as they are. Therefore, it is not necessary to read out and decompress the compressed data stored in the compressed pitch segment database. Accordingly, the shown embodiment of the voice synthesizing system can reduce calculation amount for decompression of the compressed data in comparison with that in the prior art.

For example, when eight mutually distinct and not overlapping pitch segments are stored in the cache processing portion 25, 40 to 50% of the pitch segments to be used in the waveform generating portion 24 can be used from the cache processing portion 25. Therefore, calculation amount required for the pitch segments in corresponding amount can be reduced.

Second Embodiment

Figure 2:
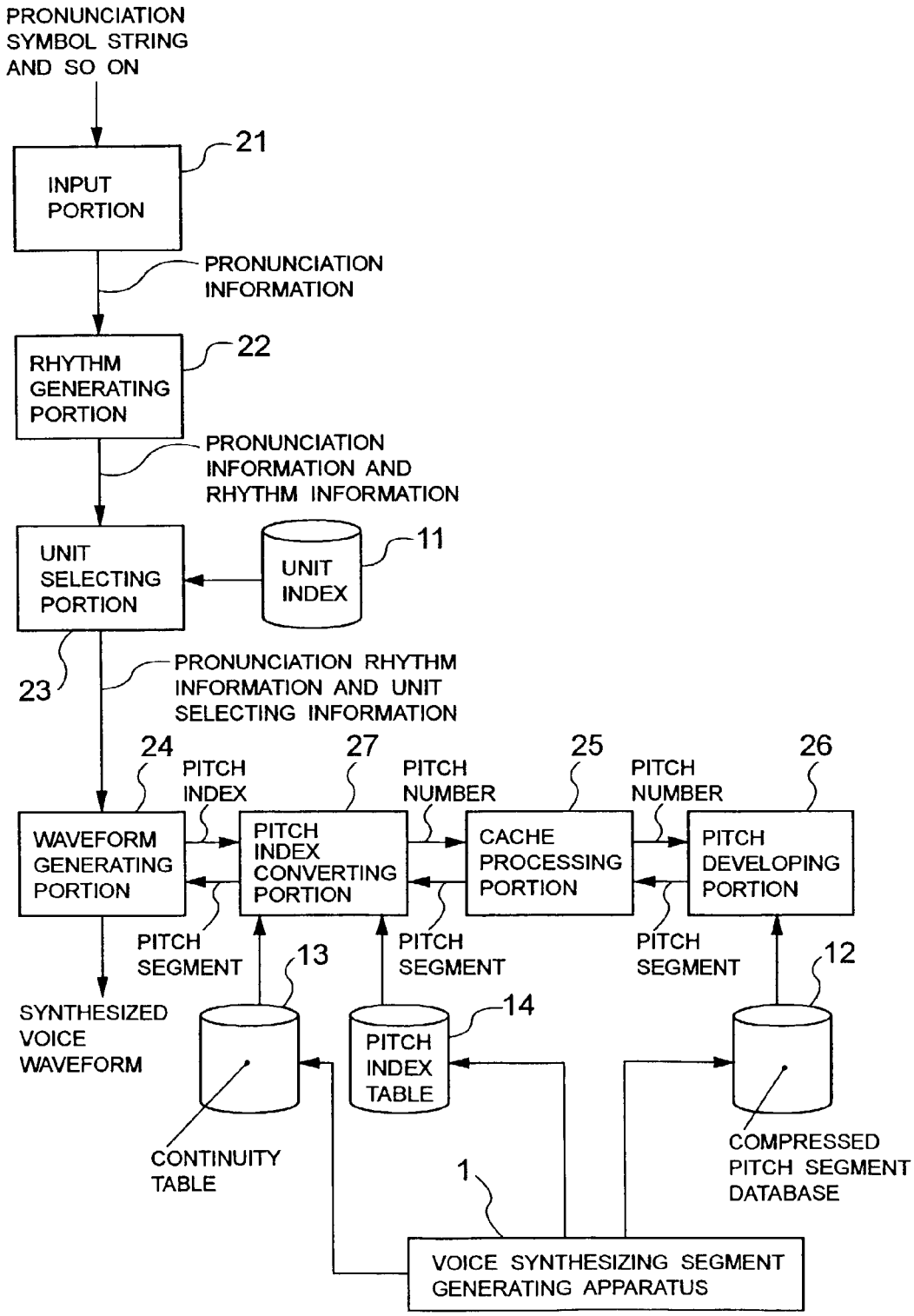
FIG. 2 is a block diagram showing a construction of the second embodiment of a voice synthesizing system according to the present invention.

FIG. 2 is a block diagram showing a construction of the second embodiment of the voice synthesizing system according to the present invention.

As shown in FIG. 2, the second embodiment of the voice synthesizing system is constructed by adding a pitch index converting portion 27, a continuity table 13 and s pitch index table 14 to the first embodiment of the voice synthesizing system shown in FIG. 1.

In the compressed pitch segment database, the continuity table 13 and the pitch index table 14, information necessary for voice synthesis by a voice synthesizing segment generating apparatus are stored similarly to the first embodiment.

The shown embodiment of the voice synthesizing system has a construction adapted for the case where the value of the pitch index and the pitch number do not match with each other. More particularly, the voice synthesizing system is applied for the case where one pitch number is assigned for a plurality of pitch segments to store in the compressed pitch segment database.

When no significant variation in acousticity even as replaced with a certain representative pitch segment by expanding and contracting amplitude of the pitch segment (can be regarded as the same), a plurality of pitch segments are expressed by the representative pitch segment to store by the pitch segments by assigning the pitch number only for the representative pitch segment. However, in such case, in order to reproduce respective original segments, information of multiplying factor of amplitude for the representative pitch segment becomes necessary.

In the continuity table 13, when a plurality of sequential pitch segments can be expressed by one representative pitch segment, the pitch number, number of sequential pitch segments and amplitude multiplying factors of respective pitch segments are stored, respectively. On the other hand, in the pitch index table 14, when a plurality of pitch segments can be expressed by one representative pitch segment irrespective of sequential or non-sequential (hereinafter referred to as set), its pitch index pitch number, amplitude multiplying factors of respective pitch segment, and number of samples for shifting process in time direction are stored respectively.

The waveform generating portion transmits the value of the pitch index to a pitch index converting portion 27 for obtaining the pitch element to be used for voice synthesis, and obtains the pitch segment corresponding to the pitch index from the pitch index converting portion 27.

The pitch index converting portion 27 makes reference to at least one of the continuity table 13 and the pitch index table 14, to convert the value of the pitch index transmitted from the waveform generating portion into the pitch number. Then, a demand for obtaining the pitch segment is output to the cache processing portion by the converted pitch number, and the corresponding pitch segment is obtained from the cache processing portion. On the other hand, for the pitch segment obtained from the cache processing portion, amplification process by amplitude multiplying factors or shifting process in time direction by sample number are performed with reference to the continuity table 13 and the pitch index table 14.

The shown embodiment of the voice synthesizing system can make file capacity required for storing the pitch segments small by representing a plurality of pitch segments which can be regarded as the same, by one pitch segment and whereby reducing storage region of the compressed pitch segment database required for storing those plurality of pitch segments into that required for storing one representative pitch segment.

On the other hand, since possibility of using the same pitch segment upon voice synthesis becomes high, probability to obtain the pitch segment from the cache processing portion becomes higher to reduce calculation amount in the voice synthesizing process.

It should be noted that while extraction error of the pitch segment directly influences for quality of the synthesized sound, possibility of avoiding the pitch element on which extraction error is caused, can be increased by representing a plurality of pitch segments which can be regarded as the same, by one pitch segment and by appropriately selecting the selection method of the representative pitch segment among the pitch segments to make sound quality of the synthesized sound stable to make it easy to listen.

Third Embodiment

Figure 3:
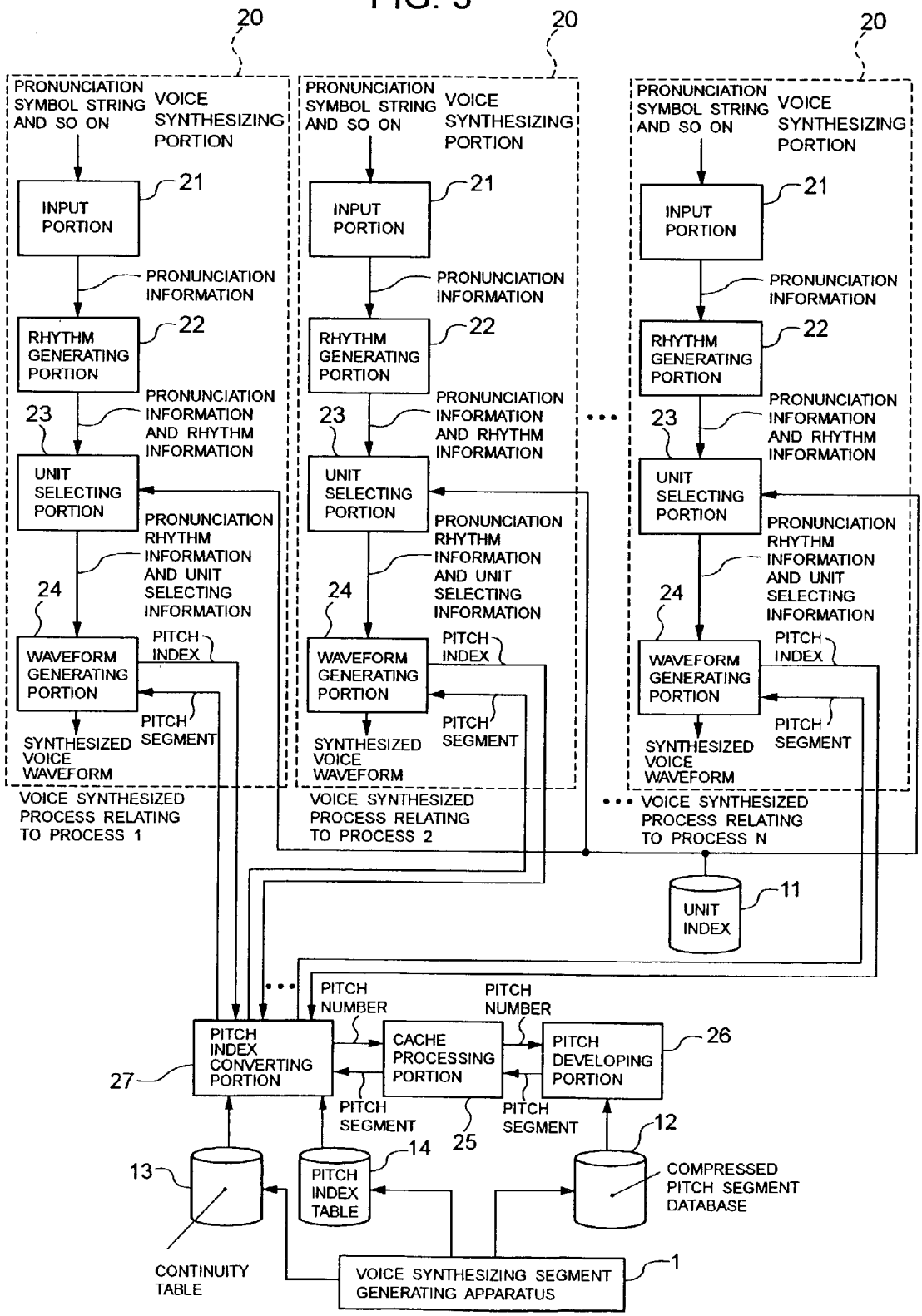
FIG. 3 is a block diagram showing a construction of the third embodiment of a voice synthesizing system according to the present invention.

FIG. 3 is a block diagram showing a construction of the third embodiment of a voice synthesizing system according to the present invention.

As shown in FIG. 3, the third embodiment of the voice synthesizing system includes a plurality of voice synthesis processing portion 20 which are consist of the input portion, the rhythm generating portion, the unit selecting portion and the waveform generating portion. Respective voice synthesis processing portions 20 are constructed to commonly use a pitch index converting portion, a continuity table, a pitch index table, a cache processing portion, a pitch developing portion, a compressed pitch segment data table and a unit index.

The voice synthesis processing portions 20 have similar construction to the first embodiment, respectively, and normally assigned respective functions to the computer for independent operation, respectively.

A unit selecting portion included in each voice synthesis processing portion 20 performs selection of synthesizing unit using the unit index in common.

On the other hand, the waveform generating portion included in each voice synthesis processing portion 20 requires obtaining of the pitch segment by respective pitch index to the pitch index converting portion to obtain respective pitch segments necessary for voice synthesis.

The pitch index converting portion converts the values of the pitch indexes transmitted from respective voice synthesis processing portions 20 into pitch numbers, obtains necessary pitch segments from the cache processing portion and returns them to the waveform generating portion in the voice synthesis processing portion 20.

It should be noted that, in the compressed pitch segment database, the continuity table and the pitch index table, information necessary for voice synthesis is accumulated by the voice synthesizing segment generating apparatus in similar manner as the second embodiment set forth above.

Fourth Embodiment

Next, the fourth embodiment of the present invention will be discussed with reference to the drawings.

IN the shown embodiment, discussion will be given for the voice synthesizing segment generating apparatus for generating the compressed pitch segment database and the continuity table having the voice synthesizing system of FIG. 2.

Figure 4:
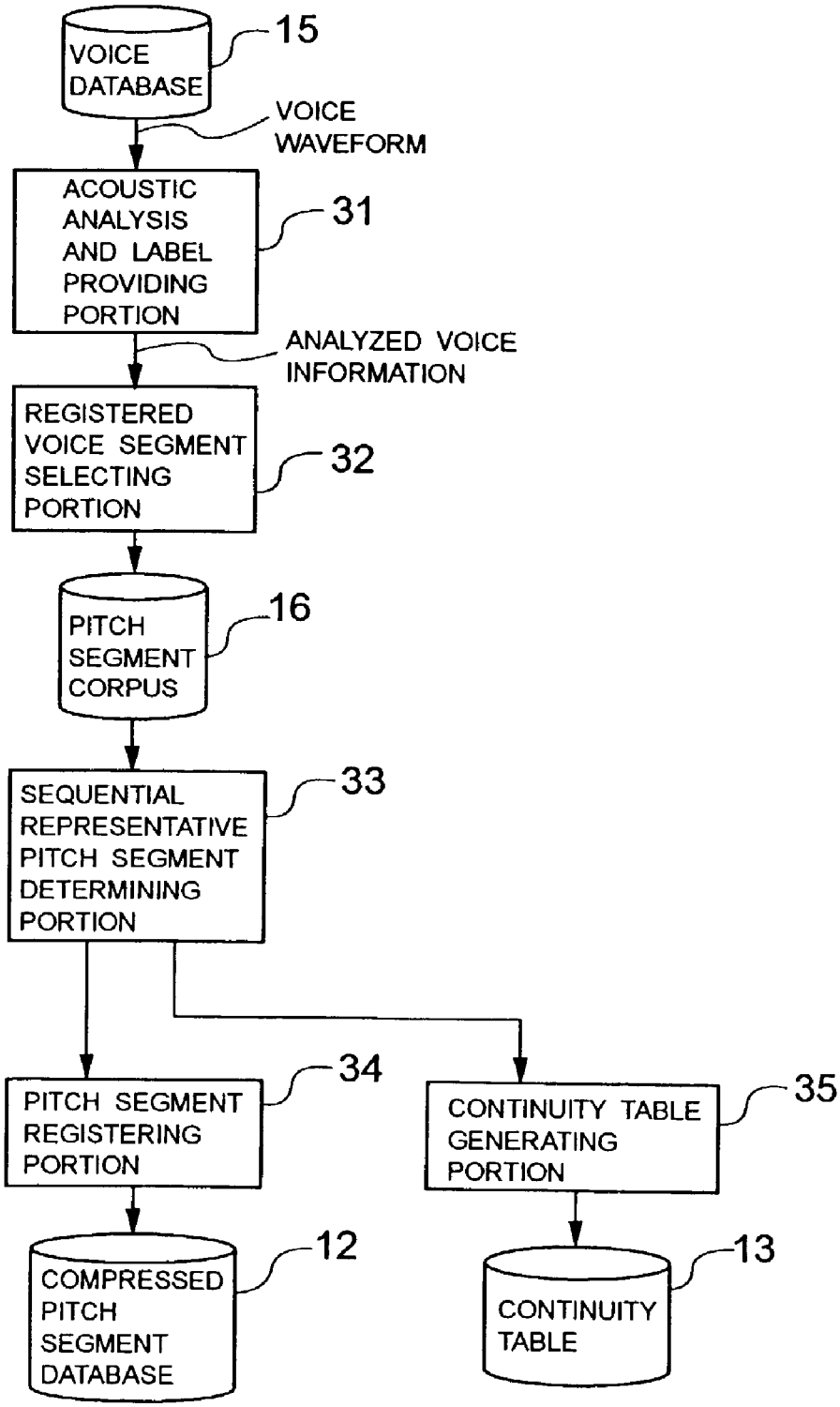
FIG. 4 is block diagram showing the fourth embodiment of the voice synthesizing system according to the present invention, in which is illustrated a construction of a voice synthesizing segment generating apparatus.

FIG. 4 is a block diagram showing the fourth embodiment of the voice synthesizing system according to the present invention, showing a construction of the voice synthesizing segment generating apparatus.

As shown in FIG. 4, the shown embodiment of the voice synthesizing segment generating apparatus is constructed with a voice database 15, an acoustic analysis and label adding portion 31, a registered voice segment selecting portion 32, a pitch segment corpus 16, a sequential representing pitch segment determining portion 33, a pitch segment registering portion 34 and a continuity table generating portion 35.

In the voice database 15, voices preliminarily spoken by persons are recorded as voice waveforms.

Figure 5:
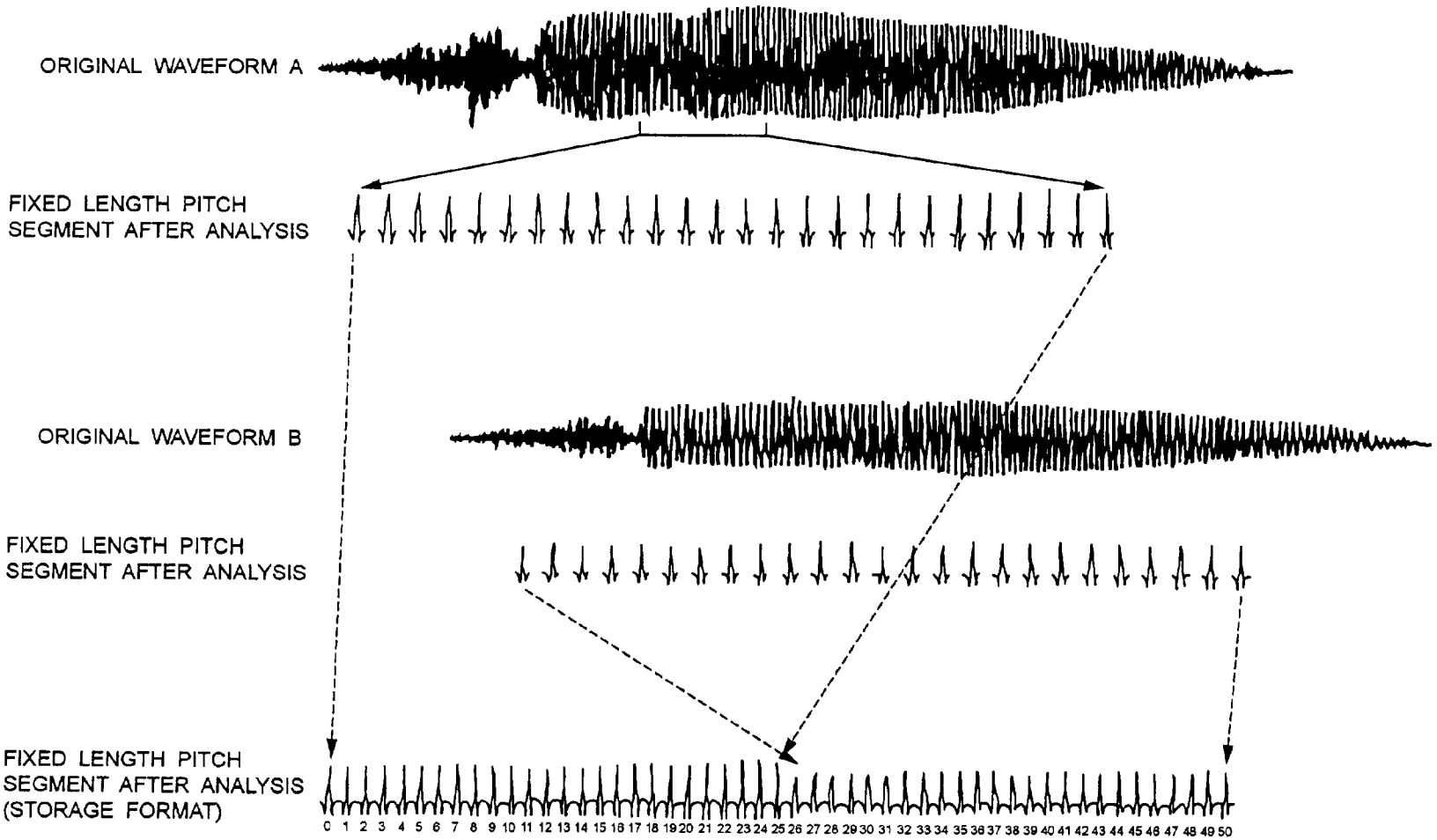
FIG. 5 is a diagrammatic illustration showing a process in the voice synthesizing segment generating apparatus shown in FIG. 4.

As shown in FIG. 5, the acoustic analysis and label adding portion 31 adds labels for respective voice waveforms obtained from a plurality of speech (original waveforms A and B in FIG. 5), and performs acoustic analysis by cepstrum analysis information and so forth to extract respective pitch segments relating to voiced sound. Then, from the results of these process, label, pitch segment, information relating to order and continuity in the original voice waveform and analyzed voice information combining results of other acoustical analysis are generated.

The registered voice segment selecting portion 32 takes out only portion including actually registered pitch segment with reference to label information among analyzed voice information to store in the pitch segment corpus 16.

The sequential representative pitch segment determining portion 33 selects a range, in which pitch segments are regarded as the same pitch segment in a sequential zone among analyzed voice information registered in the pitch segment corpus 16. The passage "regarded as the same pitch segment" means that no significant variation is caused in sound quality even by replacing the pitch segments by expanding and contracting amplitude. For example, among the result of acoustic analysis contained in the analyzed voice information, the pitch segments, differences of cepstrum values of which are smaller than a predetermined value which is preliminarily set, can be regarded as the same pitch segment. On the other hand, sequential representative pitch segment determining portion 33 selects the representative pitch segment for the range regarded as the same pitch segment. As a method for selecting the representative pitch segment, there are a method for selecting the pitch segment at leading end of the range, and a method for selecting the pitch segment having the largest amplitude within the range, for example.

Figure 6:
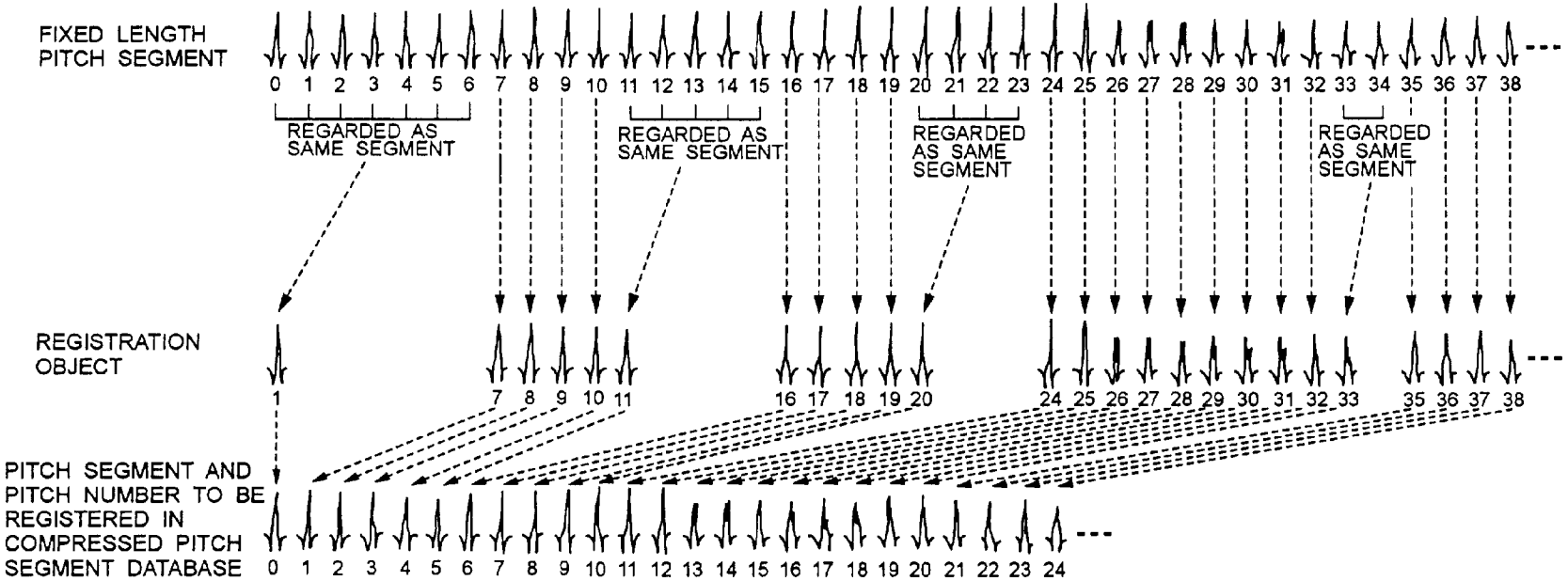
FIG. 6 is a diagrammatic illustration showing a manner of generation of a continuity table in the voice synthesizing segment generating apparatus shown in FIG. 4.

As shown in FIG. 6, the pitch segment registering portion 34 registers the representative pitch segment selected by the sequential representative pitch segment determining portion 33 for the range regarded as the same pitch segment, and registers all pitch segments in the compressed pitch segment database for other than the range set forth above.

As shown in FIG. 6, the continuity table generating portion 35 registers pitch number per respective pitch segments and number of sequential pitch segments. On the other hand, in the range represented by one pitch segment, number of sequential pitch segments and amplitude multiplying factors relative to the representative pitch segments are respectively registered in the continuity table.

It should be noted that the sequential representative pitch segments determining portion 33 is preferred not to contain the pitch segments in excess of the predetermined number in selecting the range which can be regarded as the same pitch segments in the sequential zone. In this case, degradation of naturalness of the synthesized voice can be prevented by generation of beep sound to reduce degradation of sound quality of the synthesized voice.

Fifth Embodiment

Next, discussion will be given for the fifth embodiment of the present invention with reference to the drawings.

In the shown embodiment, discussion will be given for the voice synthesizing segment generating apparatus for generating the compressed pitch segment database and the pitch index table having the voice synthesizing system of FIG. 2.

Figure 7:
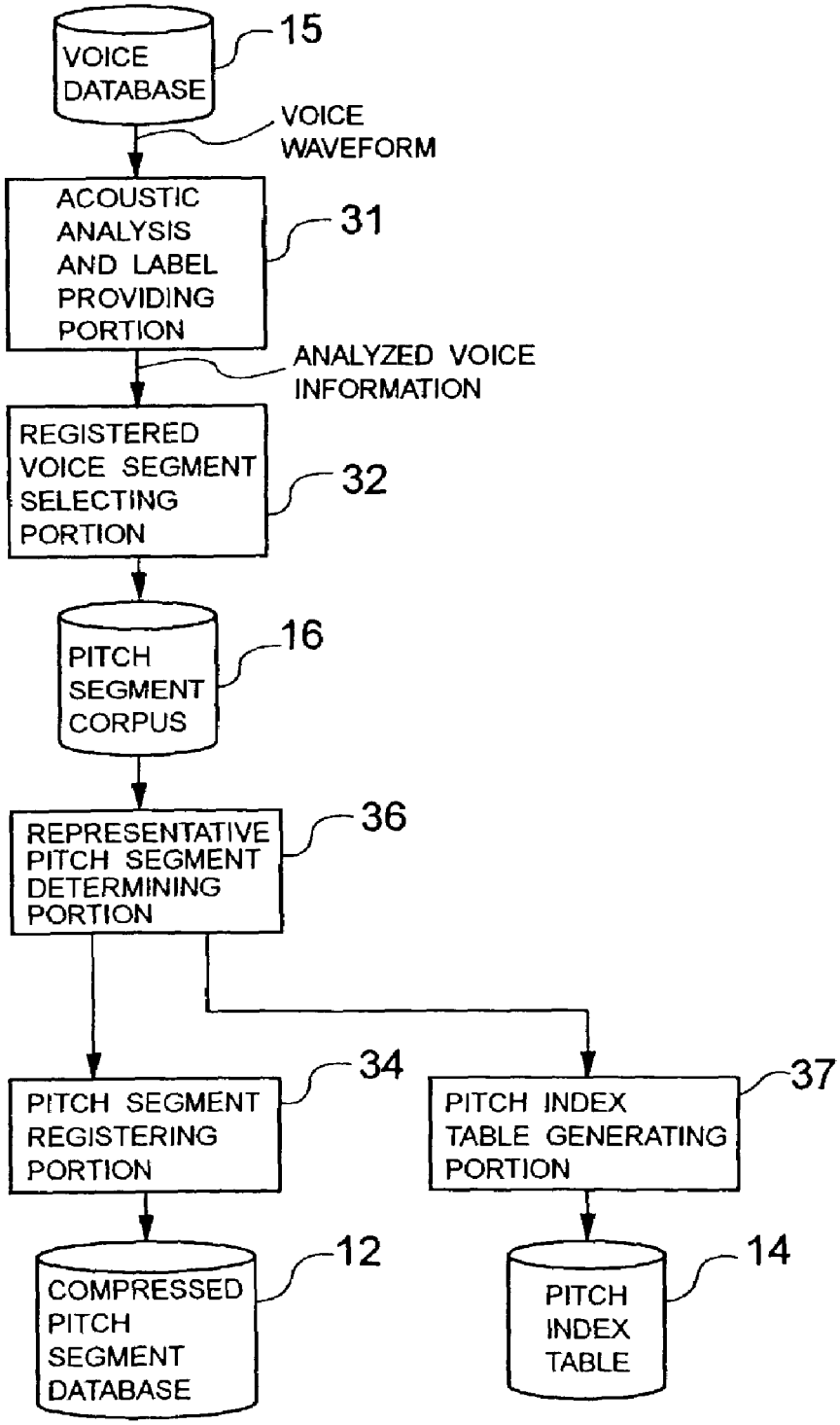
FIG. 7 is a block diagram showing the fifth embodiment of the voice synthesizing system according to the present invention, in which is illustrated a construction of a voice synthesizing segment generating apparatus.

FIG. 7 is a block diagram showing the fifth embodiment of the voice synthesizing system according to the present invention, showing the construction of the voice synthesizing segment generation apparatus.

As shown in FIG. 7, the shown embodiment of the voice synthesizing segment generating apparatus is constructed with including the acoustic analysis and label adding portion, the registered voice segment selecting portion, the pitch segment corpus, the representative pitch segment determining portion 36, the pitch segment registering portion, a pitch index table generating portion 37. The operations of the acoustic analysis and label adding portion, the registered voice segment selecting portion, the pitch segment corpus and the pitch segment registering portion are similar to the fourth embodiment. Therefore, discussion for these components will be eliminated for avoiding redundant discussion and whereby for keeping the disclosure simple enough to facilitate clear understanding of the present invention.

Figure 8:
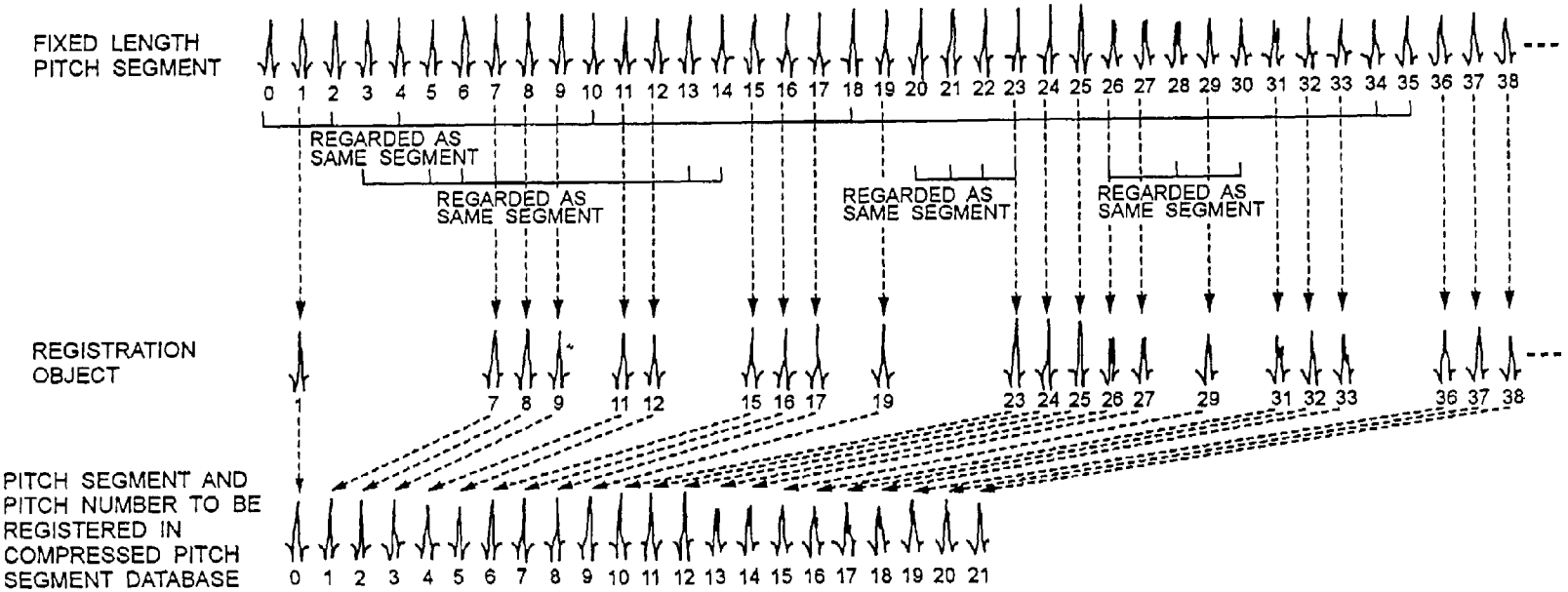
FIG. 8 is a diagrammatic illustration showing a manner of generation of a pitch index table in the voice synthesizing segment generation apparatus shown in FIG. 7.

As shown in FIG. 8, the representative pitch segment determining portion 36 selects a set of the pitch segments which can be regarded as the same pitch segment from all pitch segments of the original speech, among analyzed voice information registered in the pitch segment corpus. Here, "can be regarded as the same pitch segment" means to have no significant variation in sound quality even by replacing with other segment by expanding or contracting the amplitude of certain pitch segment. For example, among the result of acoustic analysis contained in the analyzed voice information, the pitch segments having difference of the cepstrum value smaller than the predetermined value set preliminarily are regarded as the same pitch segment. On the other hand, the representative pitch segment determining portion 36 selects the pitch segment to be representative with respect to the set regarded as the same pitch segment. As a method for selecting the representative pitch segment in each set, there is a method to register the pitch segment having the largest amplitude amount the pitch segments in the set.

The pitch segment registering portion registers the representative pitch segment for the set of the pitch segments regarded as the same pitch segment set by the representative pitch segment determining portion 36, in the compressed pitch segment database, and registers all of the pitch segments not belonging any sets in the compressed pitch segment database.

The pitch index table generating portion 37 registers each pitch index, pitch numbers of the registered pitch segments corresponding to respective pitch indexes and amplitude multiplying factors for the representative pitch segments of the pitch segments of the pitch numbers, in the pitch index table. On the other hand, sample number for shifting the pitch segment of the pitch number in time direction is calculated to register the respective results of calculation in the pitch index table.

It should be noted that the representative pitch segment determining portion 36 preferably does not include pitch segments in number in excess of the predetermined number or sequential pitch segments in number in excess of the predetermined number. In this case, degradation of naturalness of the synthesized voice can be prevented by generation of beep sound to reduce degradation of sound quality of the synthesized voice.

Sixth Embodiment

Figure 9:
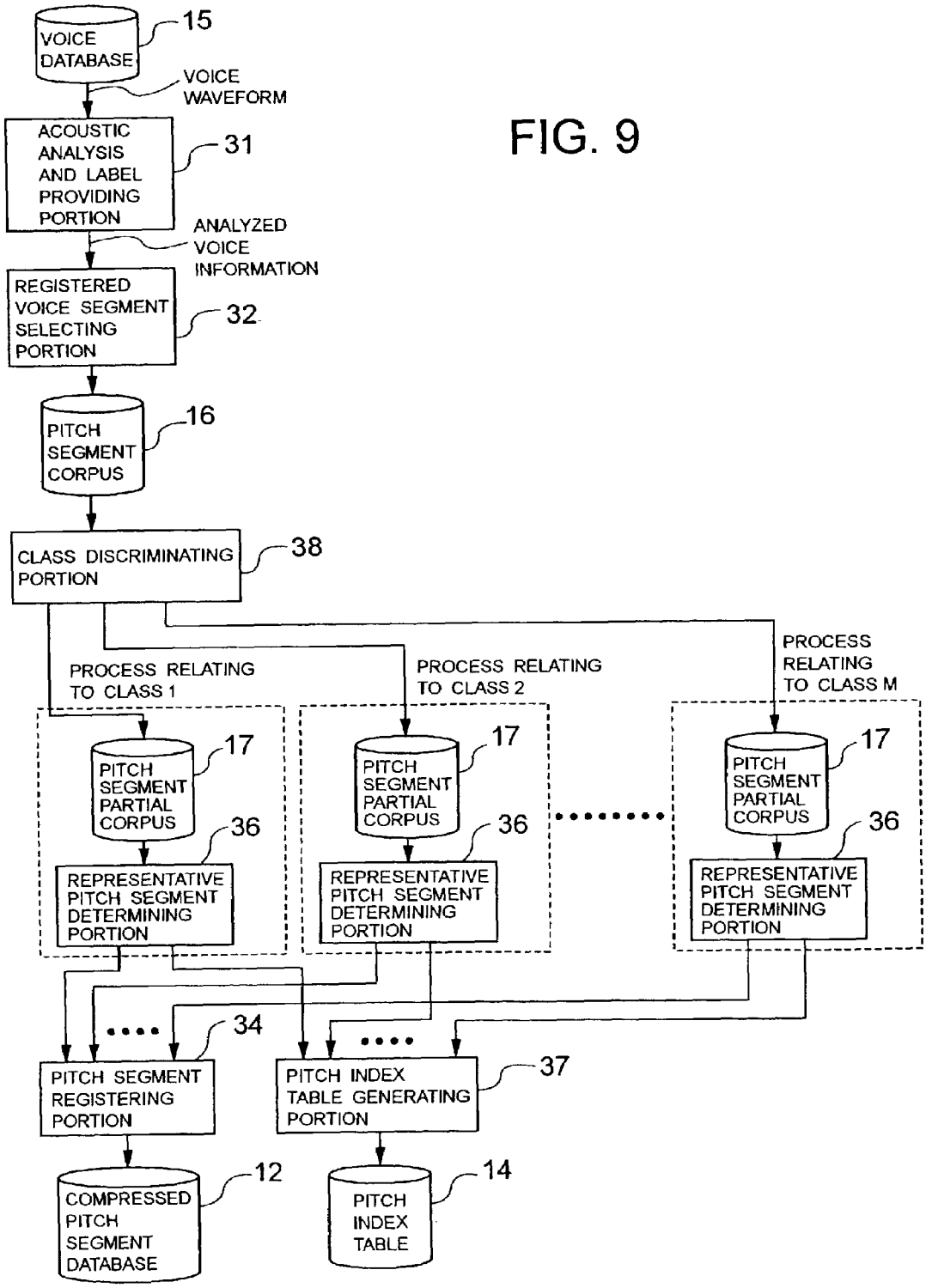
FIG. 9 is a block diagram showing the sixth embodiment of the voice synthesizing system according to the present invention, in which is illustrated a construction of a voice synthesizing segment generating apparatus.

FIG. 9 is a block diagram showing the sixth embodiment of the voice synthesizing system according to the present invention, in which is illustrated a construction of a voice synthesizing segment generating apparatus.

As shown in FIG. 9, the sixth embodiment of the voice synthesizing segment generating apparatus is constructed by including a class discriminating portion 38, a plurality pf pitch segment partial corpus 17 and a plurality of representative pitch segment determining portion in the voice synthesizing segment generating apparatus in the fifth embodiment.

The class discriminating portion 38 divides the pitch segments in the pitch segment corpus into a plurality of pitch segment partial corpus 17 on the basis of labels given in the acoustic analysis and label adding portion. After division, aggregate of the pitch segments is referred to as class. A division standard for dividing the pitch segments into classes is preliminarily determined using a phoneme in which the pitch segment belongs, the phoneme immediately preceding to the phoneme, in which the pitch segment belongs, and the phoneme immediately following the phoneme, in which the pitch segment belongs, In class, a class of vowel sound (a, i, u, e, o), a class of b sound located at the leading end (consonant portion of ba, bi, bu, be, bo), a class of b sound located other than the leading end.

The representative pitch segment determining portion performs process similar to that of the fifth embodiment for all of pitch segments of respective classes among the analyzed voice information registered in the pitch segment partial corpus.

The pitch segment registering portion and the pitch index table generating portion performs similar process to the fifth embodiment receiving the result of outputs in all classes of the representative pitch segment determining portion.

By dividing the pitch segment into a plurality of classes as in the shown embodiment, numbers or sets of the pitch segments to be regarded as the same as each class can be increased to permit further reduction of the storage capacity of the compressed pitch segment database in the voice synthesizing system.

On the other hand, since possibility of use of the same pitch segment upon voice synthesis becomes high, probability of obtaining the pitch segment from the cache processing portion becomes high to reduce calculation amount in voice synthesizing process.

Seventh Embodiment

Figure 10:
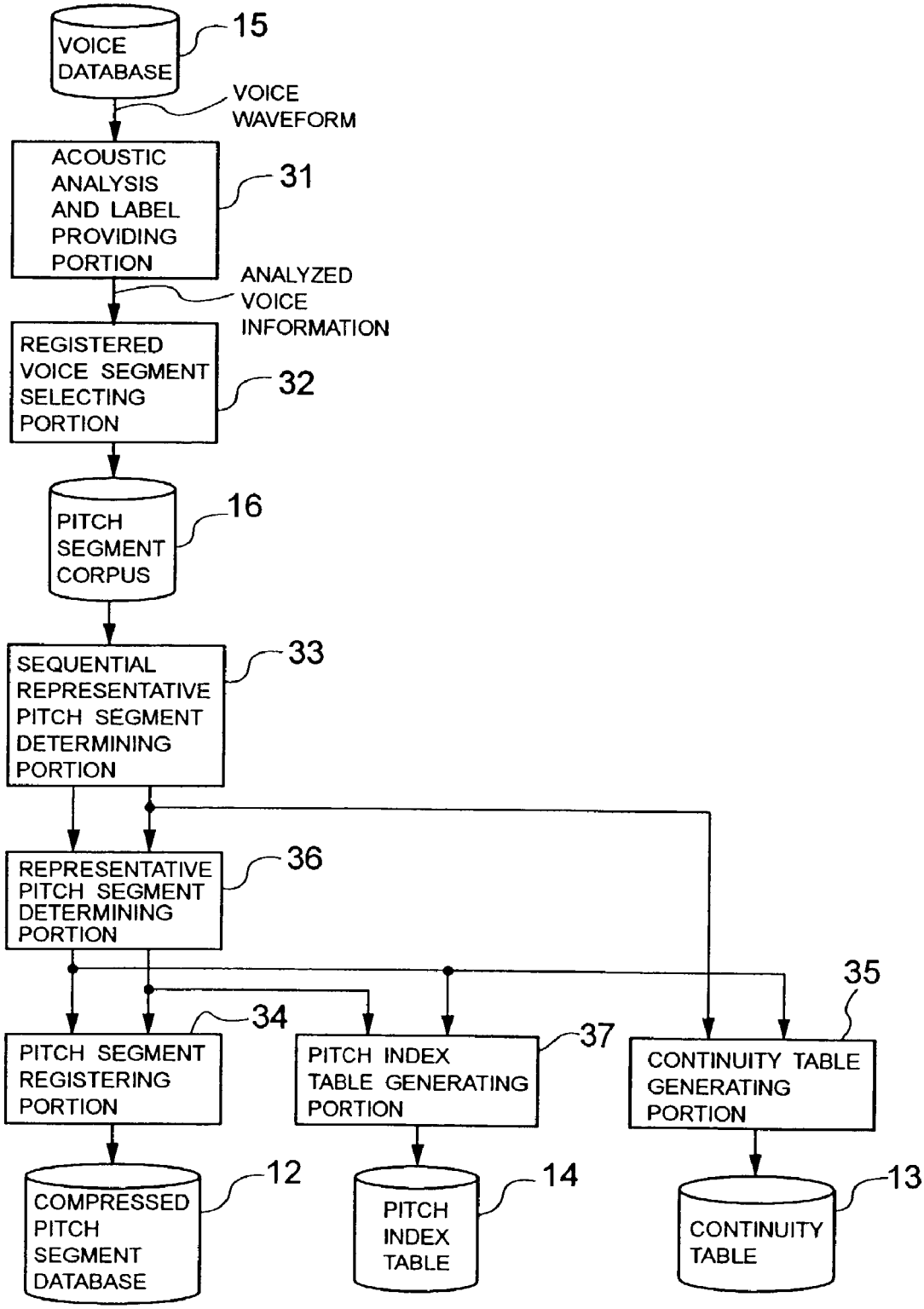
FIG. 10 is a block diagram showing the seventh embodiment of the voice synthesizing system according to the present invention, in which is illustrated a construction of a voice synthesizing segment generating apparatus.

FIG. 10 is a block diagram showing the seventh embodiment of the voice synthesizing system according to the present invention, in which is illustrated a construction of a voice synthesizing segment generating apparatus.

As shown in FIG. 10, the shown embodiment of the voice synthesizing segment generating apparatus has a construction for selecting a set to be regarded as the same pitch segment in the representative pitch segment determining portion shown in the fifth embodiment after deriving a range to be regarded as the same pitch segment in the sequential zone by the sequential representative pitch segment determining portion shown in the fourth embodiment.

It should be noted that, in the shown embodiment of the voice synthesizing segment generating apparatus, the pitch segment of the range which can be regarded as the same pitch segment in the sequential zone selected by the sequential representative pitch segment determining portion, is not an object of the representative pitch segment which is selected by the sequential representative pitch segment determining portion.

Eighth Embodiment

Figure 11:
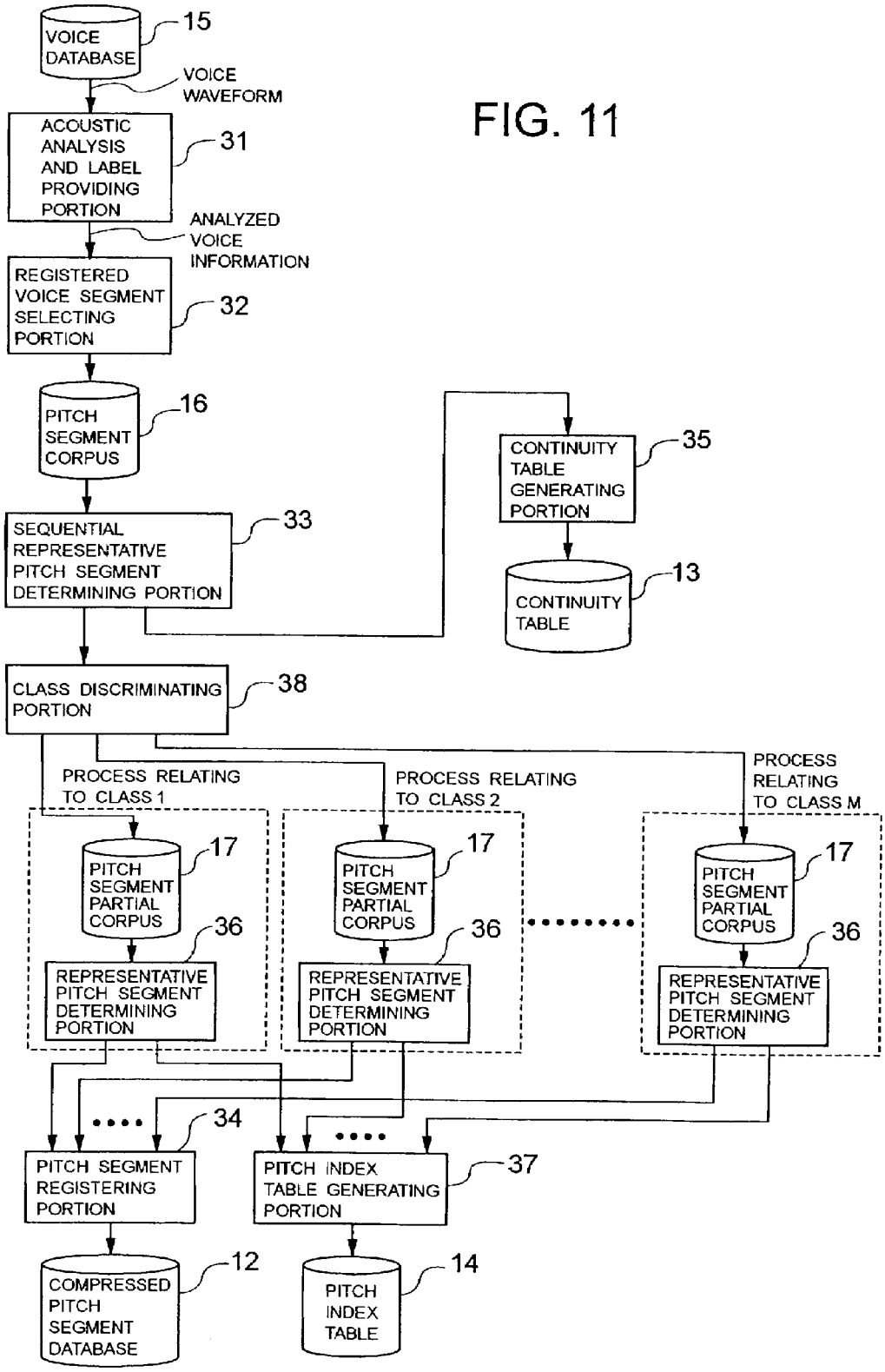
FIG. 11 is a block diagram showing the eighth embodiment of the voice synthesizing system according to the present invention, in which is illustrated a construction of a voice synthesizing segment generating apparatus.

FIG. 11 is a block diagram showing the eighth embodiment of the voice synthesizing system according to the present invention, in which is illustrated a construction of a voice synthesizing segment generating apparatus.

As shown in FIG. 11, the shown embodiment of the voice synthesizing segment generating apparatus has a construction for dividing each pitch segment into predetermined classes by the class discriminating portion shown in the sixth embodiment and for selecting a set to be regarded as the same pitch segment in the representative pitch segment determining portion after deriving a range to be regarded as the same pitch segment in the sequential zone by the sequential representative pitch segment determining portion shown in the fourth embodiment.

It should be noted that, in the shown embodiment of the voice synthesizing segment generating apparatus, the pitch segment of the range which can be regarded as the same pitch segment in the sequential zone selected by the sequential representative pitch segment determining portion, is not an object of the representative pitch segment which is selected by the sequential representative pitch segment determining portion.

Ninth Embodiment

The ninth embodiment of the voice synthesizing segment generating apparatus is differentiated from the fifth embodiment or the sixth embodiment in process of the representative pitch segment determining portion. Other construction is similar to the fifth embodiment. Therefore, redundant discussion for the common part will be eliminated from the following disclosure in order to keep the description simple enough to facilitate clear understanding of the invention.

The shown embodiment of the representative pitch segment determining portion selects the sets of the pitch segments so that the representative pitch segments are sequential in time using information of sets, in which preceding and following pitch segments belong, upon selecting the sets, in which the pitch segment belongs.

Figure 12A:
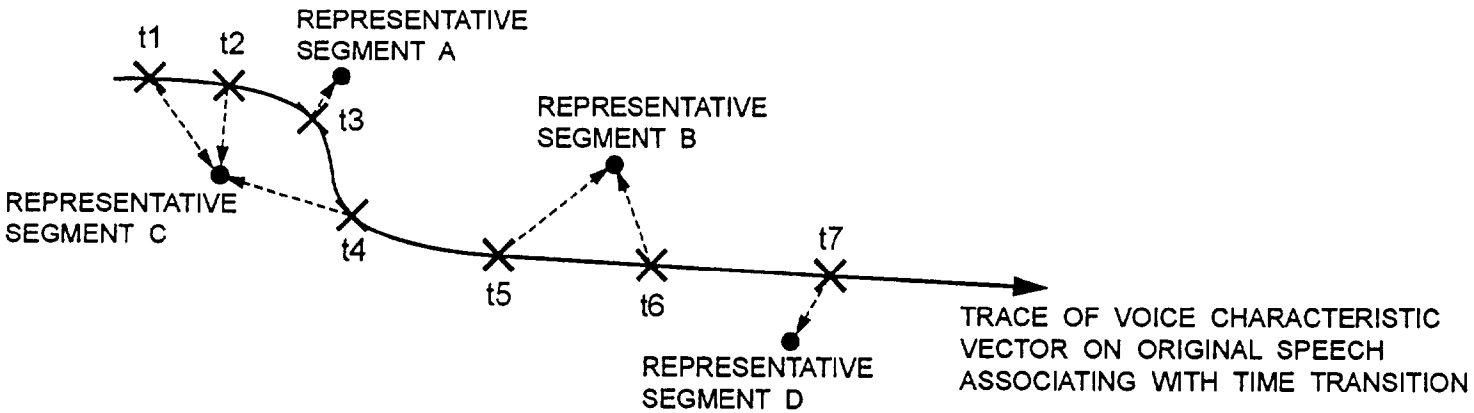
FIGS. 12A and 12B are diagrammatic illustration showing the ninth embodiment of the voice synthesizing system according to the present invention, showing a process of a representative pitch segment determining portion included in the voice synthesizing segment generating apparatus.

More particularly, as shown in FIG. 12A, several representative pitch segments are preliminarily provided to selects the set to include each pitch segment so that each pitch segment belongs in a set of the representative pitch segments having small distance on a voice characteristic vector of each pitch segment.

For example, when speech moves in a characteristic vector space as shown by arrow in FIG. 12A in association of time transition, the closest representative segment is varied as time goes. The representative segments of each pitch segment at each time are selected in sequential order of C→C→A→C→B→B→D.

Figure 12B:
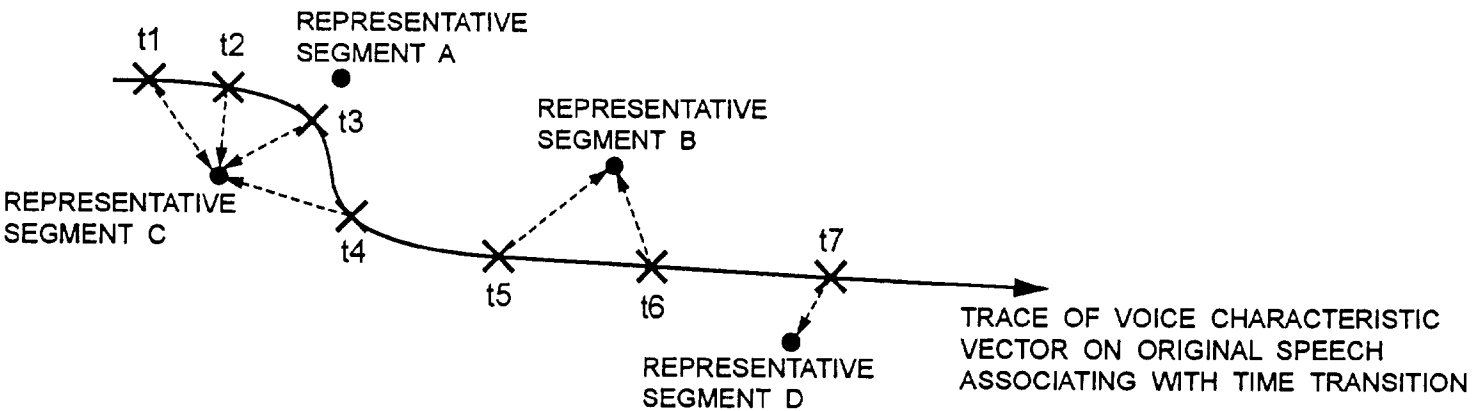

Here, as shown in FIG. 12B, considering continuity in time focusing transition of C→A→C, the representative pitch segment of the set, in which the pitch segment belongs at a time t3 is preferably the representative segment C matching with the preceding and following sets. Such process can be easily realized by using a method if DP matching.

As in the shown embodiment, in consideration of continuity in time upon deriving the sets of the pitch segments to be regarded as the same, when the original speech transit moderately, it can reduce frequency of transition of the pitch segments between a plurality of representative pitch segment to reduce generation of abnormal noise, such as gappy synthesized voice and so forth.

Tenth Embodiment

Figure 13:
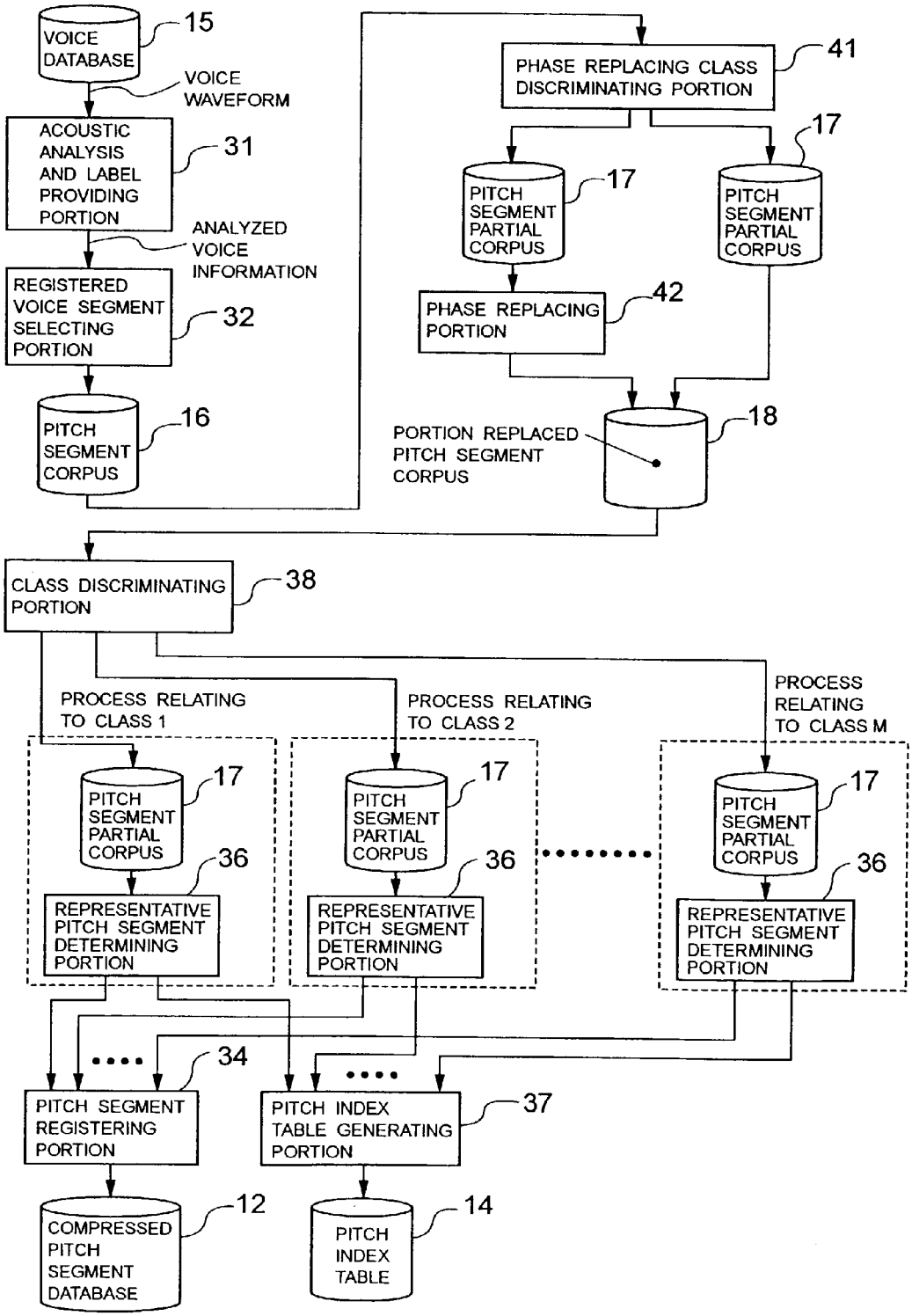
FIG. 13 is a block diagram showing the tenth embodiment of the voice synthesizing system according to the present invention, in which is illustrated a construction of a voice synthesizing segment generating apparatus.

FIG. 13 is a block diagram showing the tenth embodiment of the voice synthesizing system according to the present invention, in which is illustrated a construction of a voice synthesizing segment generating apparatus.

As shown in FIG. 13, the shown embodiment of the voice synthesizing segment generating apparatus is constructed by adding a phase replacing class discriminating portion 41, two pitch segment partial corpuses 17, a phase replacing portion 42 and a phase replaced pitch segment corpus 18 in the sixth embodiment of that.

The phase replacement class discriminating portion 41 divides the pitch segments in the pitch segment corpus into two class pitch segments partial corpus on the basis of the labels given by the acoustic analysis and label providing portion. Two classes of pitch segment partial corpus 17 are hereinafter assumed as classes A and B. In division standard, phoneme belonging the pitch segment or phonemic environment are used. It is preliminarily determined which phoneme belongs which class.

The phase replacing portion 42 replaces the phases of all of pitch segments belonging in the pitch segment partial corpus relating to class A with the preliminarily prepared phase information. Particularly, after FFT (fast Fourier transformation) of the pitch segment, amplitude component and phase component of each pitch segment are calculated respectively by conversion into polar coordination, and after replacement of the phase component, orthogonal coordinate conversion and inverse FFT are performed to realize replacement of the phases of all pitch segments with the preliminarily prepared phase information.

In the phase replaced pitch segment corpus 18, the pitch segments replaced the phase information by the phase replacing portion 42 and the pitch segment of the pitch segment partial corpus belonging class B which does not pass through the phase replacing portion 42 are registered respectively.

The class discriminating portion 38 performs process similar to the foregoing fifth embodiment for the pitch segments registered in the phase replaced pitch segment corpus.

It should be noted that the phase replaced class discriminating portion 41 and the class discriminating portion 38 generally divide the pitch segment into classes by different division standard.

By performing voice synthesis using the pitch index table generated by the shown embodiment of the voice synthesizing segment generating apparatus, the pitch segments not regarded as the same pitch segments for difference of phase structure having quite similar spectral structure, can be regarded as the same pitch segments by performing phase replacement. Since human acoustic sense is insensitive to variation in phase in comparison with variation in spectrum, various of sound quality cam be held small even with the process set forth above.

Accordingly, greater number of pitch segments may be contained in the set of the pitch segments regarded as the same pitch segment. Therefore, file capacity of the compressed pitch segment database can be reduced. On the other hand, since the pitch segments necessary for voice synthesis can be obtained at higher probability from the cache processing portion. Therefore, calculation amount for reproducing the compressed pitch segment can be reduced.

Furthermore, phase relationship between adjacent pitch segments can match with each other by phase replacement, degradation of sound quality due to abrupt variation of the phase can be reduced to lower possibility of generation of abnormal noise in the synthesized voice in the voice synthesizing system to make the sound quality stable.

Eleventh Embodiment

Figure 14:
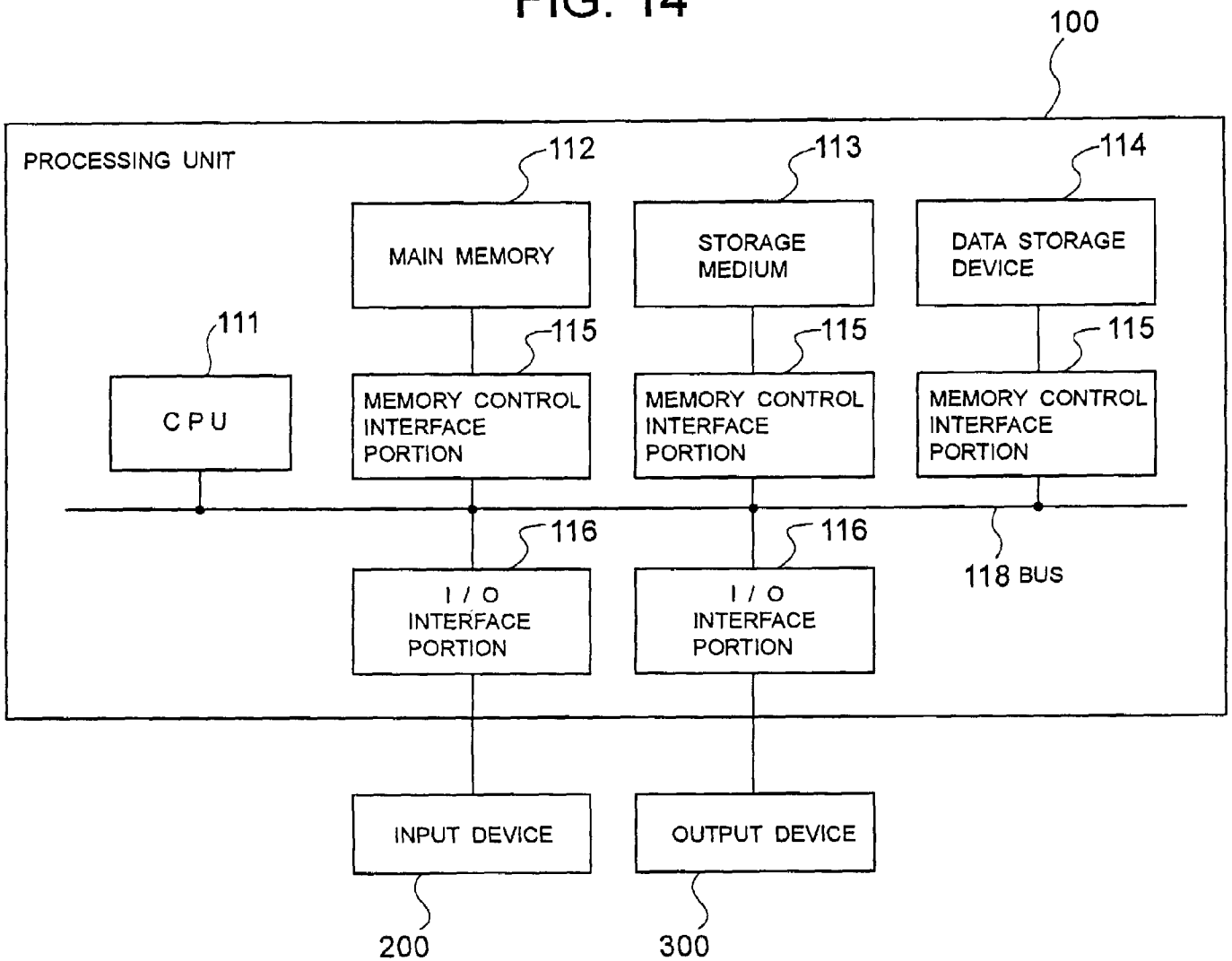
FIG. 14 is a block diagram showing the eleventh embodiment of the voice synthesizing system according to the present invention.

FIG. 14 is a block diagram showing a construction of the eleventh embodiment of the voice synthesizing system according to the present invention.

As shown in FIG. 14, the shown embodiment of the voice synthesizing system is information processing system, such as workstation, server computer, personal computer and so forth. The voice synthesizing system is constructed with a processing unit 100 for executing a predetermined process according to a program, an input device 200 for inputting commands, information and so forth to the processing unit 100, and an output device 300 for monitoring the processing result of the processing unit 100.

The processing unit 100 is constructed with CPU 111, a main memory 112 for temporarily storing information necessary for process of CPU 111, a storage medium 113 storing a control program for executing the voice synthesizing process by CPU 111 of the present invention, a data storage device 114 for recording and holding various information necessary for voice synthesis, a memory control interface 115 controlling data transfer to the data storage device 114 and an I/O interface portion 116 as an interface device with the input device 200 and the output device 300.

The processing unit 100 read out the control program stored in the storage medium 113 and executes respective process of components in the voice synthesizing system according to the control program. The storage medium 113 may be a magnetic disk, a semiconductor memory, an optical disc or other storage medium.

The main memory 112 includes a cache memory set forth above. The data storage device 114 is used as unit index, compression pitch segment database, continuity table and the pitch index table.

It should be noted that the information processing system shown in FIG. 14 operates as the voice synthesizing segment generating apparatus shown in the fourth to tenth embodiments. In this case, the processing unit 100 executes respective process of respective components of the voice synthesizing segment generating apparatus according to the control program recorded in the storage medium 113. On the other hand, the data storage device 114 is used as the voice database, the pitch segment corpus, the pitch segment partial corpus and position conversion pitch segment corpus.

Even with such constriction, it can perform the first to tenth embodiments of the voice synthesizing system or the voice synthesizing segment generating apparatus to achieve the same effect.

With the constructions set forth above, the present invention achieves the following effects:

The voice synthesizing system and the voice synthesizing segment generating apparatus constructed as set forth above provide the cache processing portion. The cache processing portion temporarily stores the voice waveform segment already used in voice synthesis. And, when the voice waveform segment necessary for voice waveform synthesis is demanded, the cache processing portion returns the demanded voice waveform segment to the demander if it is stored in the cache processing portion, And if it is not stored, the cache processing portion obtains the voice waveform segment from the compressed pitch segment database via the pitch developing portion.

Therefore, when the voice waveform segment is already stored in the cache processing portion, it becomes unnecessary to read out and decompress the compressed data stored in the compressed pitch segment database. Accordingly, it becomes possible to reduce calculation amount required for decompressing the compressed data in comparison with the prior art.

On the other hand, by providing the a continuity table respectively storing number of sequential voice waveform segment and amplitude multiplying factors per voice waveform segment with respect to a representative voice waveform segment when a plurality of sequential voice waveform segments can be replaced with one representative voice waveform segment, and a pitch index converting portion obtaining the voice waveform segment from the cache processing portion with reference to the continuity table and returns the voice waveform segment to the demander with amplification thereof by a value of the amplification multiplying factor when the voice waveform segment necessary for voice waveform synthesis is demanded, a plurality of the voice waveform segments to be stored the compressed pitch segment database can be replaced with one representative voice waveform segment. Accordingly, storage capacity of the compressed pitch segment database can be reduced.

Similarly, by providing the pitch index table storing amplitude multiplying factor per voice waveform segment with respect to the representative voice waveform segment and number of samples for shifting voice waveform segment in time direction when a plurality of voice waveform segments can be replaced with one representative voice waveform segment, and the pitch index converting portion obtaining the voice waveform segment from the cache processing portion with reference to the pitch index table, amplifying the voice waveform segments by a value of the amplitude multiplying factor, and returning the voice waveform segments to the demander with shifting the voice waveform segment in time direction with the number of samples, when the voice waveform segment necessary for voice waveform synthesis is demanded, a plurality of the voice waveform segments to be stored the compressed pitch segment database can be replaced with one representative voice waveform segment. Accordingly, storage capacity of the compressed pitch segment database can be reduced.

Although the present invention has been illustrated and described with respect to exemplary embodiment thereof, it should be understood by those skilled in the art that the foregoing and various other changes, omission and additions may be made therein and thereto, without departing from the spirit and scope of the present invention. Therefore, the present invention should not be understood as limited to the specific embodiment set out above but to include all possible embodiments which can be embodied within a scope encompassed and equivalent thereof with respect to the feature set out in the appended claims.

What is claimed is:

1. A voice synthesizing system synthesizing a predetermined voice waveform by overlaying a plurality of voice waveform segments in a waveform concatenation method, comprising:

a compressed pitch segment database storing respective voice waveform segments compressed per pitch unit;

a pitch developing portion reading out compressed data of the voice waveform segment from said compressed pitch segment database and decompressing the read out compressed data for reproducing an original voice waveform segment when the voice waveform segment necessary for voice waveform synthesis is demanded;

a cache processing portion temporarily storing the voice waveform segment already used in voice waveform synthesis, and when voice waveform segment necessary for voice waveform synthesis is demanded, returning demanded voice waveform segment to a demander when demanded voice waveform segment is already stored, and obtaining the voice waveform segment from said compressed pitch segment database via said pitch developing portion to hold the obtained voice waveform segment and conjunction therewith to return to the demander when demanded voice waveform segment is not stored.

2. A voice synthesizing system as set forth in claim 1, which further comprises:

a continuity table respectively storing number of sequential voice waveform segment and amplitude multiplying factors per voice waveform segment with respect to a representative voice waveform segment when a plurality of sequential voice waveform segments can be replaced with one representative voice waveform segment; and a pitch index converting portion obtaining the voice waveform segment from said cache processing portion with reference to said continuity table and returns the voice waveform segment to the demander with amplification thereof by a value of said amplitude multiplying factor when the voice waveform segment necessary for voice waveform synthesis is demanded, said compressed pitch segment database stores said representative voice waveform segments and the voice waveform segments which cannot be replaced with said representative voice waveform segment.

3. A voice synthesizing system as set forth in claim 1, which comprises:

a pitch index table storing amplitude multiplying factor per voice waveform segment with respect to said representative voice waveform segment and number of samples for shifting voice waveform segment in time direction when a plurality of voice waveform segments can be replaced with one representative voice waveform segment; and a pitch index converting portion obtaining the voice waveform segment from said cache processing portion with reference to said pitch index table, amplifying the voice waveform segments by a value of said amplitude multiplying factor, and returning the voice waveform segments to the demander with shifting the voice waveform segment in time direction with said number of samples, when the voice waveform segment necessary for voice waveform synthesis is demanded, said compressed pitch segment database stores said representative voice waveform segments and the voice waveform segments which cannot be replaced with said representative voice waveform segment.

4. A voice synthesizing system as set forth in claim 1, which comprises:

a continuity table respectively storing number of sequential voice waveform segment and amplitude multiplying factors per voice waveform segment with respect to a representative voice waveform segment when a plurality of sequential voice waveform segments can be replaced with one representative voice waveform segment; and a pitch index table storing amplitude multiplying factor per voice waveform segment with respect to said representative voice waveform segment and number of samples for shifting voice waveform segment in time direction when a plurality of voice waveform segments can be replaced with one representative voice waveform segment; and a pitch index converting portion obtaining the voice waveform segment from said cache processing portion with reference to one of said continuity table and said pitch index table, amplifying the voice waveform segments at least by a value of said amplitude multiplying factor, and returning the voice waveform segments to the demander with shifting the voice waveform segment in time direction with said number of samples, when the voice waveform segment necessary for voice waveform synthesis is demanded, said compressed pitch segment database stores said representative voice waveform segments and the voice waveform segments which cannot be replaced with said representative voice waveform segment.

5. A voice waveform segment generating apparatus for voice synthesis extracting a plurality of voice waveform segments from a voice waveform of an original human speech and generating information for selecting voice waveform segment necessary for voice synthesis among extracted voice waveform segments, comprising:

a sequential representative pitch segment determining portion selecting a range where voice waveform segments are regarded as the same voice waveform segment in a sequential zone and selecting representative voice waveform segment among voice waveform segments in said range;

a pitch segment registering portion storing said representative waveform segment and the voice waveform segments out of said range in a database in compressed form; and a continuity table generating portion calculating number of sequential voice waveform segments in said range and amplitude multiplying factor per voice waveform segment with respect to said voice waveform segment and storing in a storage device in a form of table.

6. A voice waveform segment generating apparatus as set forth in claim 5, wherein said sequential representative pitch segment determining portion sets the voice waveform segments contained in said range in number less than a predetermined number.

7. A voice synthesizing segment generating apparatus as set forth in claim 6, which further comprises a class discriminating portion dividing the voice waveform segments including result of selection by said continuous representative pitch segment determining portion into a preliminarily set plurality of classes using a phoneme, in which the voice waveform segment belongs, a preceding phoneme immediately preceding to said phoneme, in which the voice waveform segment belongs, and a following phoneme immediately following to said phoneme, in which the voice waveform segment belongs, and said representative pitch segment determining portion selects set of the voice waveform segment regarded as the same voice waveform segment per said class.

8. A voice synthesizing segment generating apparatus as set forth in claim 6, wherein said representative pitch segment determining portion selects representative voice waveform segments of the immediately preceding and immediately following sets and the voice waveform segments sequential in time when the representative voice waveform segment is selected among the voice waveform segments in said set.

9. A voice synthesizing segment generating apparatus as set forth in claim 6, which further comprises a phase replacing portion performing predetermined phase replacement for the phoneme and the voice waveform segments preliminarily determined depending upon phonemic environment.

10. A voice waveform segment generating apparatus for voice synthesis extracting a plurality of voice waveform segments from a voice waveform of an original human speech and generating information for selecting voice waveform segment necessary for voice synthesis among extracted voice waveform segments, comprising:

a representative pitch segment determining portion selecting a set of voice waveform segments which can be regarded as the same voice waveform and selecting representative voice waveform segment among voice waveform segments in said set;

a pitch segment registering portion storing said representative waveform segment and the voice waveform segments out of said set in a database in compressed form; and a pitch index table generating portion calculating amplitude multiplying factor per each voice waveform segment in said set with respect to said representative voice waveform segments and number of samples for shifting the voice waveform segment in time direction, and storing in a storage device in a form of table.

11. A voice waveform segment generating apparatus as set forth in claim 10, wherein said representative pitch segment determining portion sets the voice waveform segments contained in said sets in number less than a predetermined number.

12. A voice waveform segment generating apparatus for voice synthesis extracting a plurality of voice waveform segments from a voice waveform of an original human speech and generating information for selecting voice waveform segment necessary for voice synthesis among extracted voice waveform segments, comprising:

a sequential representative pitch segment determining portion selecting a range where voice waveform segments are regarded as the same voice waveform segment in a sequential zone and selecting representative voice waveform segment among voice waveform segments in said range;

a representative pitch segment determining portion selecting a set of voice waveform segments which can be regarded as the same voice waveform with respect to the result of selection by said sequential representative pitch segment determining portion and selecting representative voice waveform segment among voice waveform segments in said set;

a pitch segment registering portion storing said representative waveform segment and the voice waveform segments out of said set in a database in compressed form;

a continuity table generating portion calculating number of voice waveform segments in said range and amplitude multiplying factor per voice waveform segment with respect to said voice waveform segment and storing in a storage device in a form of table; and a pitch index table generating portion calculating amplitude multiplying factor per each voice waveform segment in said set with respect to said representative voice waveform segments and number of samples for shifting the voice waveform segment in time direction, and storing in a storage device in a form of table.

13. A voice synthesizing segment generating apparatus as set forth in claim 12, wherein said sequential representative pitch segment determining portion sets the voice waveform segments contained in said range in number less than a predetermined number, and said representative pitch segment determining portion sets the voice waveform segments contained in said sets in number less than a predetermined number.

14. A voice synthesizing method for synthesizing a desired voice waveform by overlaying a plurality of voice waveform segments in waveform concatenation method, comprising the steps of:

preliminarily storing compressed voice waveform segments in a database;

returning the voice waveform segment to a demander when the voice waveform segment necessary for voice waveform synthesis is demanded and if the demanded voice waveform segment is already stored in a cache memory;

reading out the compressed data of the voice waveform segment from said database storing the compressed data of the voice waveform segments and reproducing an original voice waveform segment by decompressing the read out compressed data if the demanded voice waveform segment is not stored in a cache memory; and storing the reproduced voice waveform segment in said cache memory and returning to said demander.

15. A voice synthesizing method as set forth in claim 14, which comprises the steps of:

preliminarily storing number of sequential voice waveform segment and amplitude multiplying factor per each voice waveform segment in said storage device with respect to said representative voice waveform segment when a plurality of sequential voice waveform segments can be replaced with one representative voice waveform segment;

obtaining the voice waveform segment from said cache memory when the voice waveform segment necessary for voice waveform synthesis is demanded; and returning the voice waveform segment to the demander with amplification by a value of said amplitude multiplying factor.

16. A voice synthesizing method as set forth in claim 14, which comprises the steps of:

preliminarily storing amplitude multiplying factor per each voice waveform segment with respect to said representative voice waveform segment and number of samples for shifting the voice waveform segments in time direction in said storage device when a plurality of voice waveform segments can be replaced with one representative voice waveform segment;

obtaining the voice waveform segment from said cache memory when the voice waveform segment necessary for voice waveform synthesis is demanded; and returning the voice waveform segment to the demander with amplification by a value of said amplitude multiplying factor and shifting the voice waveform segment by said sample number.

17. A voice synthesizing segment generating method extracting a plurality of voice waveform segments from an originally spoken human speech and generating information for selecting the voice waveform segment necessary for voice synthesis from the extracted voice waveform segment, comprising the steps of:

selecting range, in which the voice waveform segments re regarded as the same within a sequential zone among all of voice waveform segments consisting the original speech, and selecting a representative voice waveform segment from the voice waveform segment within said range;

storing said representative voice waveform segments and said voice waveform segment other than said range in a database in compressed form; and calculating number of sequential voice waveform segments within said range and amplitude multiplying factor per each waveform segment with respect to said representative voice waveform segment and storing in a storage device in a form of table.

18. A voice synthesizing segment generating method as set forth in claim 17, wherein number of the voice waveform segments contained in said range is less than a predetermined number.

19. A voice synthesizing segment generating method extracting a plurality of voice waveform segments from an originally spoken human speech and generating information for selecting the voice waveform segment necessary for voice synthesis from the extracted voice waveform segment, comprising the steps of:

selecting set of the voice waveform segments regarded as the same among all of voice waveform segments consisting the original speech, and selecting a representative voice waveform segment from the voice waveform segment within said set;

storing said representative voice waveform segments and said voice waveform segment other than said set in a database in compressed form; and calculating amplitude multiplying factor per each waveform segment with respect to said representative voice waveform segment and number of samples for shifting the voice wave form in a time direction, in said set and storing in a storage device in a form of table.

20. A voice synthesizing segment generating method as set forth in claim 19, wherein number of the voice waveform segments contained in said set is less than a predetermined number.

21. A voice synthesizing segment generating method as set forth in claim 19, which further comprises steps of dividing the voice waveform segments including result of selection by said continuous representative pitch segment determining portion into a preliminarily set plurality of classes using a phoneme, in which the voice waveform segment belongs, a preceding phoneme immediately preceding to said phoneme, in which the voice waveform segment belongs, and a following phoneme immediately following to said phoneme, in which the voice waveform segment belongs, and selecting set of the voice waveform segment regarded as the same voice waveform segment per said class.

22. A voice synthesizing segment generating method as set forth in claim 19, wherein representative voice waveform segments of the immediately preceding and immediately following sets and the voice waveform segments sequential in time are selected when the representative voice waveform segment is selected among the voice waveform segments in said set.

23. A voice synthesizing segment generating method as set forth in claim 19, which further comprises a step of performing predetermined phase replacement for the phoneme and the voice waveform segments preliminarily determined depending upon phonemic environment.

24. A voice synthesizing segment generating method extracting a plurality of voice waveform segments from an originally spoken human speech and generating information for selecting the voice waveform segment necessary for voice synthesis from the extracted voice waveform segment, comprising the steps of:

selecting range, in which the voice waveform segments are regarded as the same within a sequential zone among all of voice waveform segments consisting the original speech, and selecting a representative voice waveform segment from the voice waveform segment within said range;

with respect to the result of selection, selecting set of the voice waveform segments regarded as the same voice waveform segment, and selecting a representative voice waveform segment from the voice waveform segment within said set;

storing said representative voice waveform segments in said set and said voice waveform segment other than said set in a database in compressed form;

calculating number of sequential voice waveform segments within said range and amplitude multiplying factor per each waveform segment with respect to said representative voice waveform segment and storing in a storage device in a form of table; and calculating amplitude multiplying factor per each waveform segment in said set with respect to said representative voice waveform segment and number of samples for shifting the voice wave form in a time direction, in said set and storing in a storage device in a form of table.

25. A voice synthesizing segment generating method as set forth in claim 24, wherein number of the voice waveform segments contained in said range is less than a predetermined number, and number of the voice waveform segments contained in said set is less than a predetermined number.

26. A storage medium recording a program for synthesizing a desired voice waveform by overlaying a plurality of voice waveform segments in waveform concatenation method, said program comprising the steps of:

preliminarily storing compressed voice waveform segments in a database;

returning the voice waveform segment to a demander when the voice waveform segment necessary for voice waveform synthesis is demanded and if the demanded voice waveform segment is already stored in a cache memory;

reading out the compressed data of the voice waveform segment from said database storing the compressed data of the voice waveform segments and reproducing an original voice waveform segment by decompressing the read out compressed data if the demanded voice waveform segment is not stored in a cache memory; and storing the reproduced voice waveform segment in said cache memory and returning to said demander.

27. A storage medium as set forth in claim 26, wherein said program further comprises the steps of:

storing number of sequential voice waveform segment and amplitude multiplying factor per each voice waveform segment with respect to said representative voice waveform segment in a storage device when a plurality of sequential voice waveform segments can be replaced preliminarily with one representative voice waveform segment;

obtaining the voice waveform segment from said cache memory when the voice waveform segment necessary for voice waveform synthesis is demanded; and returning the voice waveform segment to the demander with amplification by a value of said amplitude multiplying factor.

28. A storage medium as set forth in claim 26, wherein said program further comprises the steps of:

storing amplitude multiplying factor per each voice waveform segment with respect to said representative voice waveform segment and number of samples for shifting the voice waveform segments in time direction in a storage device when a plurality of voice waveform segments can be replaced preliminarily with one representative voice waveform segment;

obtaining the voice waveform segment from said cache memory when the voice waveform segment necessary for voice waveform synthesis is demanded; and returning the voice waveform segment to the demander with amplification by a value of said amplitude multiplying factor and shifting the voice waveform segment by said sample number.

29. A storage medium recording a program extracting a plurality of voice waveform segments from an originally spoken human speech and generating information for selecting the voice waveform segment necessary for voice synthesis from the extracted voice waveform segment, said program comprising the steps of:

selecting range, in which the voice waveform segments are regarded as the same within a sequential zone among all of voice waveform segments consisting the original speech, and selecting a representative voice waveform segment from the voice waveform segment within said range;

storing said representative voice waveform segments and said voice waveform segment other than said range in a database in compressed form; and calculating number of sequential voice waveform segments within said range and amplitude multiplying factor per each waveform segment with respect to said representative voice waveform segment and storing in a storage device in a form of table.

30. A storage medium as set forth in claim 29, wherein number of the voice waveform segments contained in said range is less than a predetermined number.

31. A storage medium as set forth in claim 30, wherein number of the voice waveform segments contained in said set is less than a predetermined number.

32. A storage medium recording a program extracting a plurality of voice waveform segments from an originally spoken human speech and generating information for selecting the voice waveform segment necessary for voice synthesis from the extracted voice waveform segment, said program comprising the steps of:

selecting set of the voice waveform segments regarded as the same among all of voice waveform segments consisting the original speech, and selecting a representative voice waveform segment from the voice waveform segment within said set;

storing said representative voice waveform segments and said voice waveform segment other than said set in a database in compressed form; and calculating amplitude multiplying factor per each waveform segment with respect to said representative voice waveform segment and number of samples for shifting the voice wave form in a time direction, in said set and storing in a storage device in a form of table.

33. A storage segment as set forth in claim 32, wherein said program further comprises steps of dividing the voice waveform segments including result of selection by said continuous representative pitch segment determining portion into a preliminarily set plurality of classes using a phoneme, in which the voice waveform segment belongs, a preceding phoneme immediately preceding to said phoneme, in which the voice waveform segment belongs, and a following phoneme immediately following to said phoneme, in which the voice waveform segment belongs, and selecting set of the voice waveform segment regarded as the same voice waveform segment per said class.

34. A storage medium as set forth in claim 32, wherein representative voice waveform segments of the immediately preceding and immediately following sets and the voice waveform segments sequential in time are selected when the representative voice waveform segment is selected among the voice waveform segments in said set.

35. A storage program as set forth in claim 32, wherein said program further comprises a step of performing predetermined phase replacement for the phoneme and the voice waveform segments preliminarily determined depending upon phonemic environment.

36. A storage medium recording a program extracting a plurality of voice waveform segments from an originally spoken human speech and generating information for selecting the voice waveform segment necessary for voice synthesis from the extracted voice waveform segment, said program comprising the steps of:

selecting range, in which the voice waveform segments are regarded as the same within a sequential zone among all of voice waveform segments consisting the original speech, and selecting a representative voice waveform segment from the voice waveform segment within said range;

with respect to the result of selection, selecting set of the voice waveform segments regarded as the same voice waveform segment, and selecting a representative voice waveform segment from the voice waveform segment within said set;

storing said representative voice waveform segments and said voice waveform segment other than said set in a database in compressed form;

calculating number of the voice waveform segments within said range and amplitude multiplying factor per each waveform segment with respect to said representative voice waveform segment and storing in a storage device in a form of table; and calculating amplitude multiplying factor per each waveform segment within said set with respect to said representative voice waveform segment and number of samples for shifting the voice wave form in a time direction and storing in a storage device in a form of table.

37. A storage medium as set forth in claim 36, wherein number of the voice waveform segments contained in said range is less than a predetermined number, and number of the voice waveform segments contained in said set is less than a predetermined number.

* * * * *